US005465108A

United States Patent [19]

Fujimoto

[11] Patent Number: 5,465,108

[45] Date of Patent: Nov. 7, 1995

[54] INK JET PRINT HEAD AND INK JET PRINTER

[75] Inventor: Hisayoshi Fujimoto, Kyoto, Japan

[73] Assignee: Rohm Co., Ltd., Kyoto, Japan

[21] Appl. No.: 897,381

[22] Filed: Jun. 11, 1992

[30] Foreign Application Priority Data

| | | | |
|---|---|---|---|
| Jun. 21, 1991 | [JP] | Japan | 3-150596 |
| Jul. 1, 1991 | [JP] | Japan | 3-160276 |
| Aug. 21, 1991 | [JP] | Japan | 3-209023 |
| Sep. 24, 1991 | [JP] | Japan | 3-242184 |

[51] Int. Cl.[6] ..... B41J 2/045

[52] U.S. Cl. ..... 347/68; 347/40; 347/71

[58] Field of Search ..... 346/140 R; 347/68, 347/71, 70, 40; B41J 2/045

[56] References Cited

U.S. PATENT DOCUMENTS

| | | | |
|---|---|---|---|
| 4,032,929 | 6/1977 | Fischbeck et al. | 346/140 R |
| 4,158,847 | 6/1979 | Heinzl et al. | 346/140 R |
| 4,189,734 | 2/1980 | Kyser et al. | 346/1.1 |
| 4,216,483 | 8/1980 | Kyser et al. | 346/140 R |
| 4,368,476 | 1/1983 | Uehara et al. | 346/140 R |
| 4,375,066 | 2/1983 | Herd | 346/140 R |
| 4,502,058 | 2/1985 | Koto | 346/140 R |
| 4,566,018 | 1/1986 | Nilsson | 346/140 R |
| 4,584,590 | 4/1986 | Fischbeck et al. | 346/140 R |
| 4,641,153 | 2/1987 | Cruz-Uribe | 346/140 R |
| 4,752,789 | 6/1988 | Maltsev | 346/140 R |
| 4,879,568 | 11/1989 | Bartky et al. | 346/140 R |
| 4,887,100 | 12/1989 | Michaelis et al. | 346/140 R |
| 4,992,808 | 2/1991 | Bartky et al. | 346/140 R |
| 5,003,679 | 4/1991 | Bartky et al. | 29/25.35 |
| 5,028,936 | 7/1991 | Bartky et al. | 346/140 R |

FOREIGN PATENT DOCUMENTS

| | | | |
|---|---|---|---|
| 0364136 | of 1990 | European Pat. Off. | B41J 2/045 |
| 3438033 | of 1986 | Germany | B41J 2/045 |
| 60-68963 | of 1985 | Japan | B41J 2/045 |

OTHER PUBLICATIONS

IBM Technical Disclosure Bulletin, "Drop-on-Demand Ink Jet Nozzle Array w/two nozzles/piezoelectric Crystal" Mar. 1981.

*Primary Examiner*—Benjamin R. Fuller
*Assistant Examiner*—Alrick Bobb
*Attorney, Agent, or Firm*—Wolf, Greenfield & Sacks

[57] ABSTRACT

An ink jet print head comprising: a diaphragm array including a group of bending curved partitions defining a multiplicity of orderly arranged ink channels, an upper end wall bridging between upper ends of partitions and a lower end wall bridging between lower ends of the partitions; an orifice board fixed to one surface of each of the upper and lower end walls of the diaphragm array and closing one mouth of each ink channel with a slight gap with respect to the individual partitions so as to allow the individual partitions to bend, the orifice board having a multiplicity of ink jet orifices communicating with the respective ink channels; a back board fixed to the other surface of each of the upper and lower end walls of the diaphragm array and closing the other mouth of each ink channel with a slight gap with respect to the individual partitions so as to allow the individual partitions to bend, the back board having a multiplicity of ink supply inlets through which ink is to be supplied to the respective ink channels; and a piezoelectric actuator for bending the individual partitions of the diaphragm array selectively.

27 Claims, 16 Drawing Sheets

INK JET PRINT HEAD AND INK JET PRINTER

BACKGROUND OF THE INVENTION

1. Field of the Invention

This invention relates to an ink jet print head and an ink jet printer, and more particularly to an ink jet print head in which the volume of an individual ink channel filled with ink is changed by a piezoelectric actuator to jet ink to a recording paper from the ink channel to make a desired print. The invention additionally relates to an ink jet printer, for a word processor, a facsimile machine, a plotter or the like, in which such a print head is mounted.

2. Description of the Related Art

As a printer for a word processor, a facsimile machine or a plotter, various types of ink jet printers have currently been put to practical use in which a piezoelectric actuator is used.

One of these conventional ink jet printers is a so-called Kyser type, which is disclosed in, for example, U.S. Pat. Nos. 4,189,734 and 4,216,483. Generally this Kyser type print head has the following construction. There are supported on a print head base individual ink channels branching from a common ink channel and leading to respective jet nozzles. A diaphragm array is attached to the head base so as to cover the individual ink channels; when the flexure of the diaphragm is vibrated, the volume of the individual ink channel is varied to make an ink jet to the paper at every vibration. For driving the diaphragm to vibrate, piezoelectric devices are fixed to the diaphragm array at positions corresponding to the individual ink channels; upon application of a voltage to the selected piezoelectric devices, they will be displaced to move the diaphragm array locally. As a result, the individual ink channels corresponding to the moved portion of the diaphragm array will change in volume to thrust out ink from the nozzles.

Various improvements have been made to this Kyser type ink jet printer, as disclosed in Japanese Patent Laid-Open Publications Nos. SHO63-252750 and SHO 63-247051 and U.S. Pat. Nos. 4,879,568, 4,887,100, 4,992,808, 5,003,679 and 5,028,936 corresponding to the last-named Japanese Publication.

With this improved print head, it is possible to provide a high-density ink jet printer which is operable by less energy.

However, modern ink jet printers require much higher dot density, and yet the piezoelectric multi-channel diaphragm array can not cope with such high-density printing. Thus the conventional arrangement would cause only a low printing quality with an attempted increase in print dot density, and so it is impossible to satisfy the demands for high density and high quality at the same time. If attempts were made to achieve high-density and high-quality printing by a mass-production print head, the cost of production would have exceeded the practical range.

High-quality and high-density printing also needs high-viscosity ink. When using high-viscosity ink, it is necessary to shorten the individual ink channel of the print head to reduce fluid friction. With the conventional print head, it is difficult to shorten the individual ink channels, and so high-viscosity ink cannot be used, or it will cause jamming. In other words, with the conventional arrangement, the extent to which the diaphragm is to be vibrated by the driving force of the piezoelectric devices is limited, otherwise the foregoing problems occurred. It is also difficult to achieve a multi-channel print head which is high in both density and quality and is small in size.

Therefore a printer equipped with such an ink jet print head is large in size.

Further, since the extent of vibration of the diaphragm is small, the individual ink channel would necessarily be long, which makes the printer large in size and occasionally causes jamming. Particularly if high-viscosity ink is used in an attempt to achieve high-speed and high-density printing, it would very probably result in jamming so that various reconstructions would be necessary, thus making the printer much larger in size.

SUMMARY OF THE INVENTION

It is therefore an object of this invention to provide an improved ink jet print head which can realize high-density and high-quality printing, and an ink jet printer equipped with such a print head.

Another object of the invention is to provide an ink jet print head which has a simple construction and can achieve a high rate of production, and an ink jet printer equipped with such a print head.

Still another object of the invention is to provide an inexpensive high-quality ink jet print head with which high-viscosity ink can be used, and an ink jet printer equipped with such a print head.

A further object of the invention is to provide a high-density and high-quality ink jet print head of the multi-channel or the line type, and an ink jet printer equipped with such a print head.

According to a first aspect of the invention, there is provided an ink jet print head comprising: a diaphragm array including a group of bending curved partitions defining a multiplicity of orderly arranged ink channels, an upper end wall bridging between upper ends of the partitions and a lower end wall bridging between lower ends of the partitions; an orifice board fixed to one surface of each of the upper and lower end walls of the diaphragm array and closing one mouth of each of the ink channels with a slight gap with respect to the individual partitions so as to allow the individual partitions to bend, the orifice board having a multiplicity of ink jet orifices communicating with the respective ink channels; a back board fixed to the other surface of each of the upper and lower end walls of the diaphragm array and closing the other mouth of each ink channel with a small gap with respect to the individual partitions so as to allow the individual partitions to bend, the back board having a multiplicity of ink supply inlets through which ink is to be supplied to the respective ink channels; and a piezoelectric actuator for bending the individual partitions of the diaphragm array selectively.

According to a second aspect of the invention, there is provided an ink jet printer which comprises an ink jet print head disposed in confronting relation to a recording paper for jetting ink to the paper in a desired dot pattern, an ink source for supplying ink to the ink jet print head, and a scanner movable forwardly and backwardly to scan over the paper, wherein the ink jet print head includes: individual piezoelectric elements which are formed by cutouts at positions confronting the respective ink channels and which are thereby orderly arranged to confront the respective partitions; individual electrodes each formed on the diaphragm-array side of the individual piezoelectric element; and a common electrode formed on the stationary-plate side of the thin-plate piezoelectric device With this arrangement, partly since the plural curved ink channels are arranged orderly in the diaphragm array, and partly since the piezoelectric actuator gives a bending force to the curved partitions defining the individual ink channels, that the curved partitions are bent longitudinally. As a result, the volume of the individual ink channel can be varied by bending the partition even though the driving extent of the piezoelectric actuator is small, and thus an ink jetting force of adequately high pressure can be obtained even with a small-size print head.

In this invention, partly since the piezoelectric actuator is a piezoelectric device disposed adjacent to one end wall of the diaphragm array, a bending force is applied to the corresponding partition when a predetermined voltage is applied to the piezoelectric device. The selected partition will thereby have the bending extent changed to instantly vary the volume of the ink channel.

When the volume of the ink channel is increased, ink will be sucked into the ink channel from an ink source; when the volume of the ink channel is reduced, the ink sucked into the ink channel will be jetted to a paper from the orifice.

According to this invention, when the partitions of the plural curved channels of the diaphragm array are moved by the piezoelectric actuator, ink in the channel will be thrust and jetted out from the orifice to perform a predetermined printing operation in response to the change of volume of the ink channel. The ink jetting action in the case where the piezoelectric devices are attached to the partitions of the diaphragm array will now be described in more detail.

The piezoelectric devices are disposed one at each of the ink channels along one end wall, each piezoelectric device being polarized longitudinally along the partition. Each piezoelectric device has an individual electrode on one surface toward the partition and a common electrode on the opposite surface. As a result, when a voltage whose polarity is opposite to the above-mentioned polarization is applied between the two electrodes, the individual piezoelectric device will exert a bending force on the partition in such a direction that the partition is bent longitudinally. This selected partition will be further bent, in a direction of increasing curvature, to reduce the volume of the ink channel at one side of the partition and, at the same time, to increase the volume of the ink channel at the other side of the partition.

When the applied voltage is removed, the piezoelectric device will be deactivated so that the diaphragm array will be restored to its original stationary form.

Further, when the polarity of the applied voltage is inverted, the piezoelectric device will act on the partition so as to pull the partition longitudinally so that the partition will bend, in a direction of reducing curvature, to change the respective volumes of the channels at opposite sides of the partition in a manner reverse to the above-mentioned.

Therefore by utilizing the change of volume of the ink channel, it is possible to control the sucking and jetting of ink.

According to this invention, by giving an expanding and shrinking action or a pulling action on the curved partition of the diaphragm array by the piezoelectric actuator, it is possible to change the volume of the ink channel markably. Thus this ink jet print head, unlike the conventional print head, can give a large jetting force with the use of even less energy.

In this invention, the piezoelectric device may comprise lead zirco-titanate and may be polarized at the manufacturing stage of the device itself or in the processing stage subsequent thereto.

The piezoelectric actuator includes a piezoelectric device disposed along the end wall of the diaphragm array and a pair of individual electrodes disposed at opposite sides of the piezoelectric device for the respective partition. In this case, when a voltage is applied to the pair of electrodes of the piezoelectric device corresponding to the driven partition so as to have a polarity different from that of each adjacent pair of electrodes, a shearing force will be exerted on the piezoelectric device so that a compressing force or an expanding force will be applied to the selected partition, thus changing the volume of the ink channel as described above. Thus if it is driven in the shearing mode, a desired driving force can be obtained by fixedly attaching the piezoelectric device to the partition of the diaphragm array, without restricting the movement of the piezoelectric device by a stationary plate fixed on a side opposite to the diaphragm array.

In this invention, since it is to be in the form of a small line-type array having an increased number of channels, the diaphragm array is preferably manufactured by a light etching process using photosensitive glass, for example, which enables a very fine process to be carried out.

By forming the diaphragm array itself of a piezoelectric material, it is possible to form the diaphragm array and the piezoelectric actuator in a unitary form, thus making the print head structure very simple.

Further, by applying a voltage of a predetermined polarity to a pair of electrodes formed on the curved partition surfaces of the piezoelectric diaphragm array, it is possible to expand and shrink the partition longitudinally for bending. Accordingly it is possible to change the volume of the ink channel at each of opposite sides of the partition easily by moving this partition.

This bending action of the partition will now be described in greater detail.

The diaphragm array composed of piezoelectric devices is polarized in the direction of the array. When a voltage of a certain polarity is applied to the individual partition defining the ink channel from the electrode formed on the partition, the partition will be expanded or shrunk longitudinally according to both the polarity of polarization of the piezoelectric material and the polarity of the applied voltage. This expansion or shrinkage will cause the individual partition to make a large movement in the direction of the array, i.e. in the direction of increasing or reducing the curvature. As a result, the volume of the ink channel at each of opposite sides of the partition will be increased or reduced.

More specifically, for instance, each partition of the diaphragm array is polarized at the convex side positively and at the concave side negatively. If a negative voltage is applied to the convex side of the partition while a positive voltage is applied to the concave side of the partition, this partition will be expanded so as to reduce the curvature, thus making a large movement in the direction of the array. As a result, the volume of the ink channel at the convex side of the partition will increase while the volume of the ink channel at the concave side of the partition will decrease.

Then when the applied voltage is removed, the partition will return to its original posture.

Further, when the polarity of the applied voltage is inverted, the partition will be moved in the shrinking direction, i.e. in the direction of increasing the curvature, Therefore, by controlling the application of this voltage, It is possible to control the ink sucking or jetting action of a desired ink channel.

If the piezoelectric diaphragm array is polarized in a predetermined array direction, the individual ink channel requires only a single electrode rather than a pair of electrodes. In this case, by applying to the selected ink channel a voltage opposite in polarity to a pair of adjacent ink channels, it is possible to give an expanding or compressing force to the selected partition. With this structure, the number of electrodes for each ink channel can be one and so it can contribute greatly to the simplification of the print head.

The diaphragm array of this invention is formed of a piezoelectric material such as lead zirco-titanate, and its direction of polarization should be set correctly in the direction of the array. This polarizing process may be performed after ink channels have been formed and further an electrode and a protective film have been patterned on the individual partition. However, on many occasions such a polarizing process would be difficult to perform; consequently it is preferable to form the ink channels after the piezoelectric material itself has been previously polarized in this case, it is important to treat the diaphragm array at a temperature below the Curie point so as not to annihilate the polarization. Generally, such a piezoelectric diaphragm array is formed preferably by a laser process, mold process or ultrasonic process in a KOH solution or EXCIMER laser.

DETAILED DESCRIPTION

Several preferred embodiments of an ink jet print head according to this invention will now be described with reference to the accompanying drawings.

Figure 1:
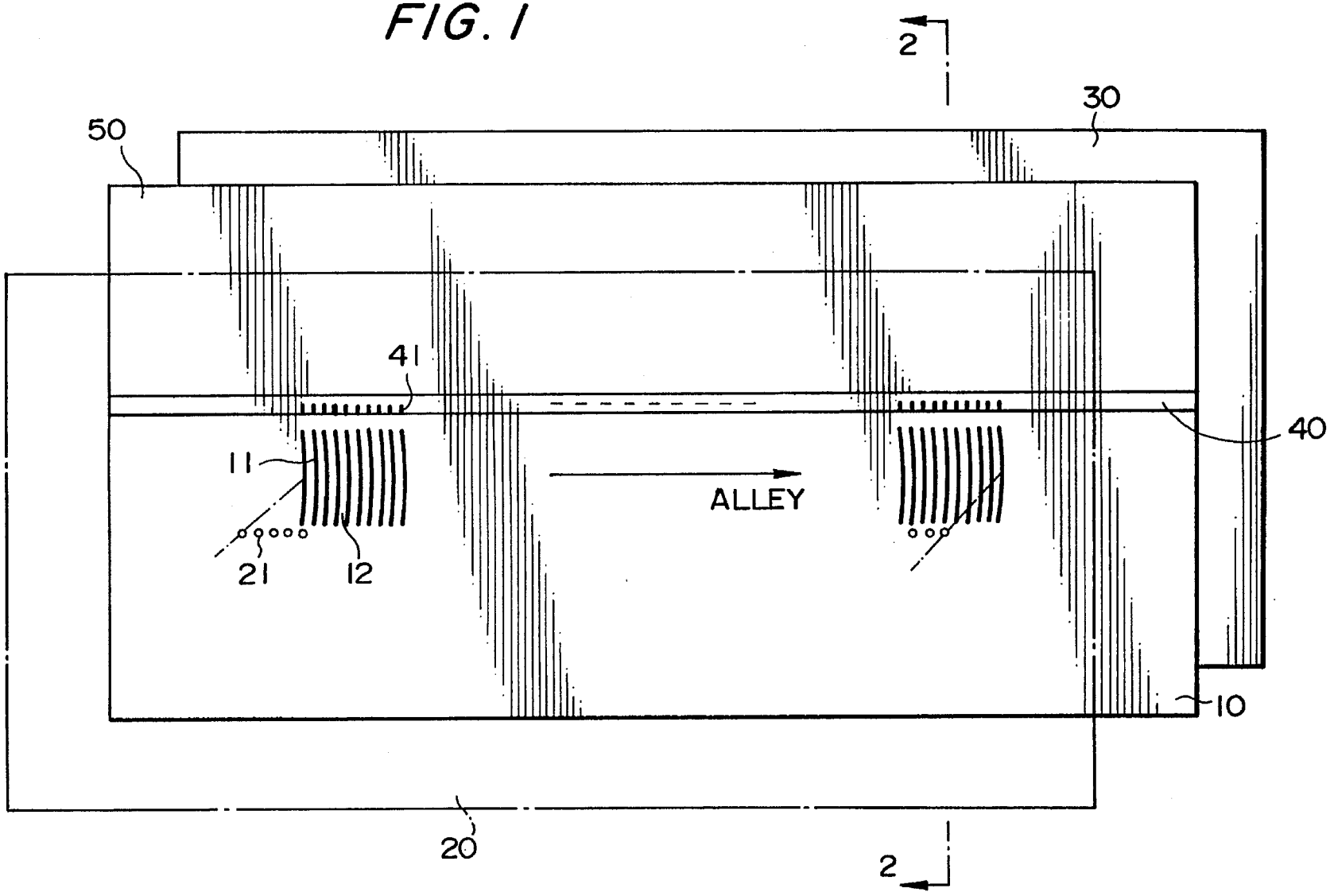
FIG. 1 is an exploded front view of an ink jet print head according to a first embodiment of this invention, showing the print head from the side of a printing paper.
Figure 2:
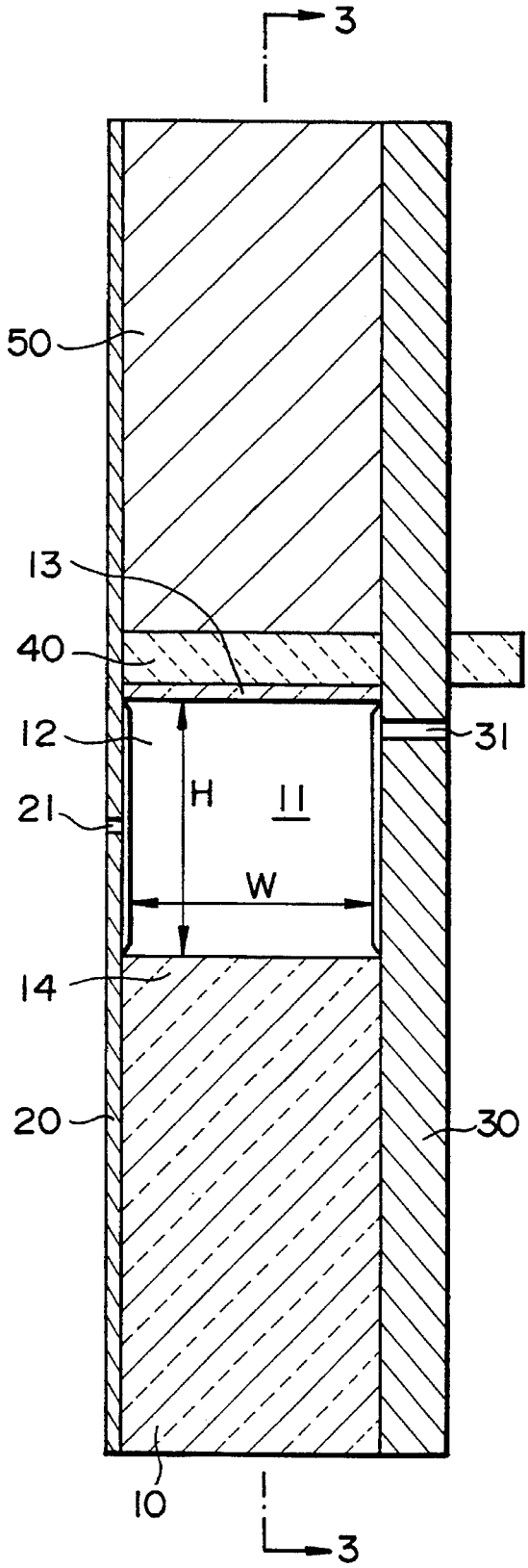
FIG. 2 is a side cross-sectional view taken along line 2—2 of FIG. 1, showing a main portion of the print head.
Figure 3:
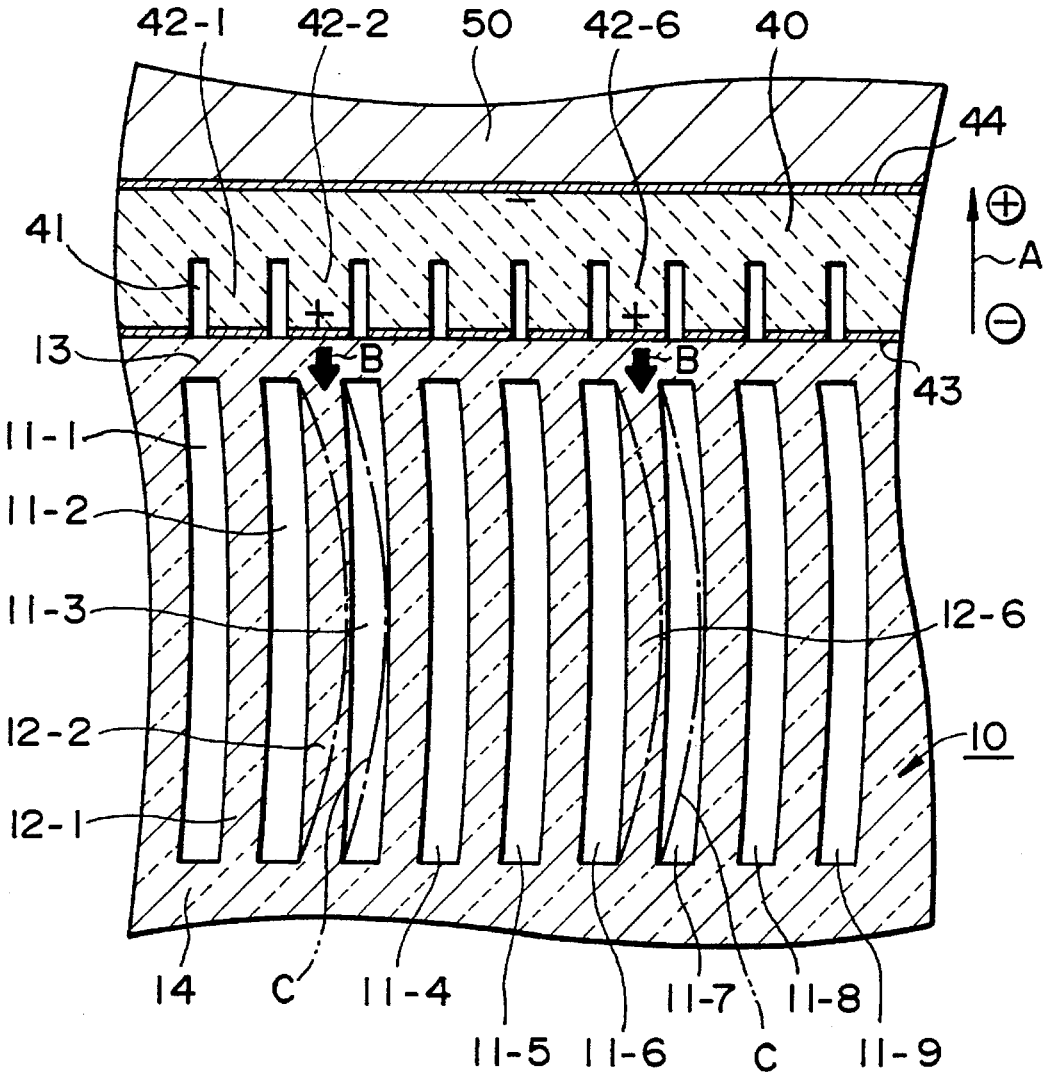
FIG. 3 is an enlarged cross-sectional view taken along line 3—3 of FIG. 2, illustrating an ink jetting action.

FIGS. 1 through 3 show the first embodiment of this invention. FIG. 1 is an exploded front view of a print head suitable for an ink jet printer to be used in a word processor, a facsimile machine, a plotter or the like, showing the print head from the side of a printing paper; FIG. 2 is a fragmentary cross-sectional view of FIG. 1; FIG. 3 is an enlarged cross-sectional view taken along the array of FIG. 2.

In this embodiment, the print head comprises a diaphragm array 10, an orifice board 20 disposed on a front surface of the diaphragm array 10, a back board 30 disposed on a rear surface of the diaphragm array 10, and a piezoelectric actuator 40. The piezoelectric actuator 40 extends in the array direction ALLEY and is fixedly sandwiched between the diaphragm array 10 and a stationary plate 50. Inside the diaphragm array 10, a group of orderly arranged ink channels are formed; when the volume of the individual ink channel is changed, ink will be sucked into the ink channel, or ink in the ink channel will be jetted to a paper from the orifice. For this purpose, the diaphragm array 10 must be formed by a delicate process. In this embodiment, the diaphragm array 10 is formed of photosensitive glass, and the ink channels are formed precisely by light etching.

More specifically, as shown in FIGS. 2 and 3, each of the ink channels 11 is in the form of a slit-like hollow extending through the diaphragm array 10, and the individual ink channels 11 are defined by a plurality of partitions 12, an upper end wall 13 bridging between upper ends of the partitions 12, and a lower end wall 14 bridging between lower ends of the partitions 12. As a significant feature of this invention, as better shown in FIG. 3, the individual partitions 12 are arranged orderly, and each partition curved in one direction. When a desired partition is forced to bend by the piezoelectric actuator, the internal volumes of the adjacent ink channels 11 at opposite sides of the partition will vary greatly. This partition 12 serves as a diaphragm of the array 10. In this invention, since its length is adequately large, compared to its thickness, each partition 12 has an adequate bendability though it is formed of glass. In this embodiment, as shown in FIG. 2, the height H of the ink channel 11 is larger than its width W so that the partition 12 can be bent much more easily.

In the first embodiment, the number of the ink channels 11 may be set optionally according to the type of the print head. In a line printer, the ink channels 11 may be arranged in a single array and should preferably be arranged in two or more parallel arrays.

The print head of FIG. 1 is suitable for use as an ink jet dot printer head, in which the ink channels are arranged vertically.

On the front surface of the diaphragm array 10, as described above, the orifice plate 20 is disposed and has a plurality of orifices 21 communicating with the individual ink channels 11 of the diaphragm array 10; when thrust from the ink channel 11, ink will be jetted toward a paper via the orifice 21.

On the rear surface of the diaphragm array 10, as shown in FIG. 2, the back board 30 is disposed, having an ink supply inlet 31 through which ink from a nonillustrated ink source is to be supplied to every ink channel 11.

In this invention, the partitions 12 defining the individual ink channels 11 are fixed to the opposite end walls 13, 14 but are freely bendable between the end walls 13, 14. Therefore, although the diaphragm array 10 is sandwiched between the orifice board 20 and the back board 30, there is a small gap either between the orifice board 20 the individual partition 12 or between the latter and the back board 30, as overillustrated in FIG. 2. This gap is very small, practically 0.5 μm, and hence serves to greatly resist ink in the individual ink channel 11 against moving to the adjacent ink channels due to the movement of the partition 12 so that ink can be jetted toward a paper from the orifice 21 in response to the movement of the partition 12. Because of this gap, the partition 11 can be freely bent between the two end walls 13, 14.

this embodiment, the piezoelectric actuator 40 is a film-like piezoelectric device fixedly sandwiched between the diaphragm array 10 and the stationary plate 50.

The stationary plate 50 suppresses the upward movement of the piezoelectric actuator 40, normally giving a piezoelectric driving force to the partition 12 of the diaphragm array 10.

The stationary plate 50, the diaphragm array 10 and the piezoelectric actuator 40 have a common thickness, and therefore the orifice board 20 and the back board 30 are tightly fixed to the opposite end walls 13, 14 of the diaphragm array 10, the piezoelectric actuator 40 and the opposite ends of the stationary plate 50.

In the piezoelectric actuator 40 in the form of a film-like piezoelectric device, as shown in FIG. 3, a plurality of orderly arranged individual piezoelectric elements 42 confronting the respective partitions 12 are defined by cutouts 41 formed at positions which confront the respective ink channels 11. An individual electrode 43 and a common electrode 44 are formed on the diaphragm-array side and the stationary-plate side, respectively, of each piezoelectric element 42.

As is well known in the art, the piezoelectric actuator 40 is polarized at its upper portion positively and at its lower portion negatively, as indicated by an arrow A.

The operation of the print head of the first embodiment will now be described.

In this invention, ink held in the ink channel 11 is jetted toward a paper from the corresponding orifice 21 when the internal volume of the selected ink channel 11 is reduced.

For this purpose, the individual ink channel 11 has a partition 12 extending longitudinally (H) therealong and convexing in one direction. This partition 12 is supported only at opposite ends by the two end wails 13, 14 and can easily change its curvature. Therefore, in this embodiment, the piezoelectric actuator disposed on the end wall 13 of the partition 12 gives a compressing or shrinking force to the selected partition 12 in the longitudinal direction (H). As a result, a bending action is given to the partition 12; specifically, when the piezoelectric actuator 40 gives a compressing force to the partition 12, the curvature of the partition 12 will become much greater to thereby reduce the internal volume of the ink channel at the convex side of the partition and, meanwhile, increase the internal volume of the ink channel at the concave side of the partition. Reversely, when the piezoelectric actuator 40 gives an expanding force to the partition 12, this partition 12 will expand so as to reduce its curvature, thereby increasing the internal volume of the convex-side ink channel and reducing the internal volume of the concave-side ink channel.

Therefore, by giving a desired compressing or expanding action to the selected partition 12, it is possible to jet ink to a paper from the corresponding ink channel 11 via the orifice 21 or to suck ink into an appropriate ink channel from the ink supply inlet 31.

The operation of the piezoelectric actuator 40 of this embodiment will now be described in greater detail.

As shown in FIG. 3, the piezoelectric actuator 40 is an elongated piezoelectric device which is formed of lead zirco-titanate and which is divided into individual piezoelectric elements 42 by the cutouts 41. As indicated by the arrow A, the piezoelectric device is previously polarized at its upper portion positively and at its lower portion negatively. This polarization itself does not give any driving force to the diaphragm array 10, but causes an expanding or compressing force to be applied to the individual piezoelectric element 42 when a voltage is applied between the common electrode 44 and the individual electrode 43.

For eight partitions 12 and two piezoelectric devices 42-2, 42-6 selected from the individual piezoelectric elements 42, a positive voltage is applied to the individual electrodes 43-2, 43-6 while a negative voltage is applied to the common electrode 44. Thus this voltage is opposite to the direction of polarization mentioned above.

In response to tile application of a voltage opposite to this polarizing direction, tile individual piezoelectric elements 42-2, 42-6 will expand upwardly and downwardly, respectively, and the movement of the upper portion of the piezoelectric actuator 40 is suppressed by the stationary plate 50 so that the individual piezoelectric elements 42-2, 42-6 will expand downwardly as indicated by an arrow B. As a result, both the partitions 12-2, 12-6 confronting the individual piezoelectric elements 42-2, 42-6 will receive a longitudinal compressing action to become curved so as to increase the curvature, as indicated by phantom lines C. In this invention, the individual partition is arcuate in a free form and is easy to increase its curvature in one direction when the partition 12 is compressed by the piezoelectric actuator 40.

Because it is previously curved, each partition 12 can make a high-speed response to the movement of the individual piezoelectric device 42.

The partition 12 is bent firstly to suck ink into the ink channel at the concave side of the partition 12. Before activation of the piezoelectric actuator 40, there is only a small amount of ink remaining in the individual ink channel 11; ink will not be sucked into the ink channels 11-2, 11-6 at the concave side of the partition 12-2, 12-6 until the partitions 12 are bent, as shown in FIG. 3. At that time, though the internal volumes in the ink channels 11-3, 11-7 at the respective convex side of the two partitions 12-2, 12-6 will be reduced, ink will not be jetted because only a small amount of ink remains in the individual ink channel 11-3, 11-7.

From the foregoing description it can be understood that when a voltage of a desired polarity is applied to a selected individual piezoelectric device, the corresponding partition 12 will be compressed and caused to bend so as to increase its curvature. An adequate amount of ink will thereby be sucked into the concave-side ink channel whose volume increases.

When the voltage applied to the individual piezoelectric device 42 is removed after the partition 12 has been moved completely, this partition 12 will restore to its original shape. At that time excessive ink will be jetted toward a paper via the orifice 21 from the ink channel 11 into which an adequate amount of ink has been sucked.

Thus when a voltage of opposite polarity is applied to the selected individual piezoelectric device 42, the partition will be moved to suck ink into the ink channel. When the applied voltage is removed, the partition will be returned suddenly to its original position to jet ink.

Assuming that the polarity of the voltage to be applied to the individual piezoelectric device is opposite to that as described in the foregoing embodiment, the individual piezoelectric device will be compressed, due to this application of voltage, to cause the corresponding partition 12 to expand so that ink will be sucked into the ink channel 11 at the convex side of the partition 12. When the applied voltage is removed after the partition 12 has been moved, the partition 12 will restore its original shape to jet excessive ink in the convex-side ink channel 11 toward a paper from the orifice 21.

Therefore it is possible to select any polarity of the voltage applied to the individual piezoelectric device 42.

However experiments show that for a stable ink sucking action it is preferable to bend the partition 12 by expanding the individual piezoelectric device 42 in the polarizing direction A.

Figure 4:
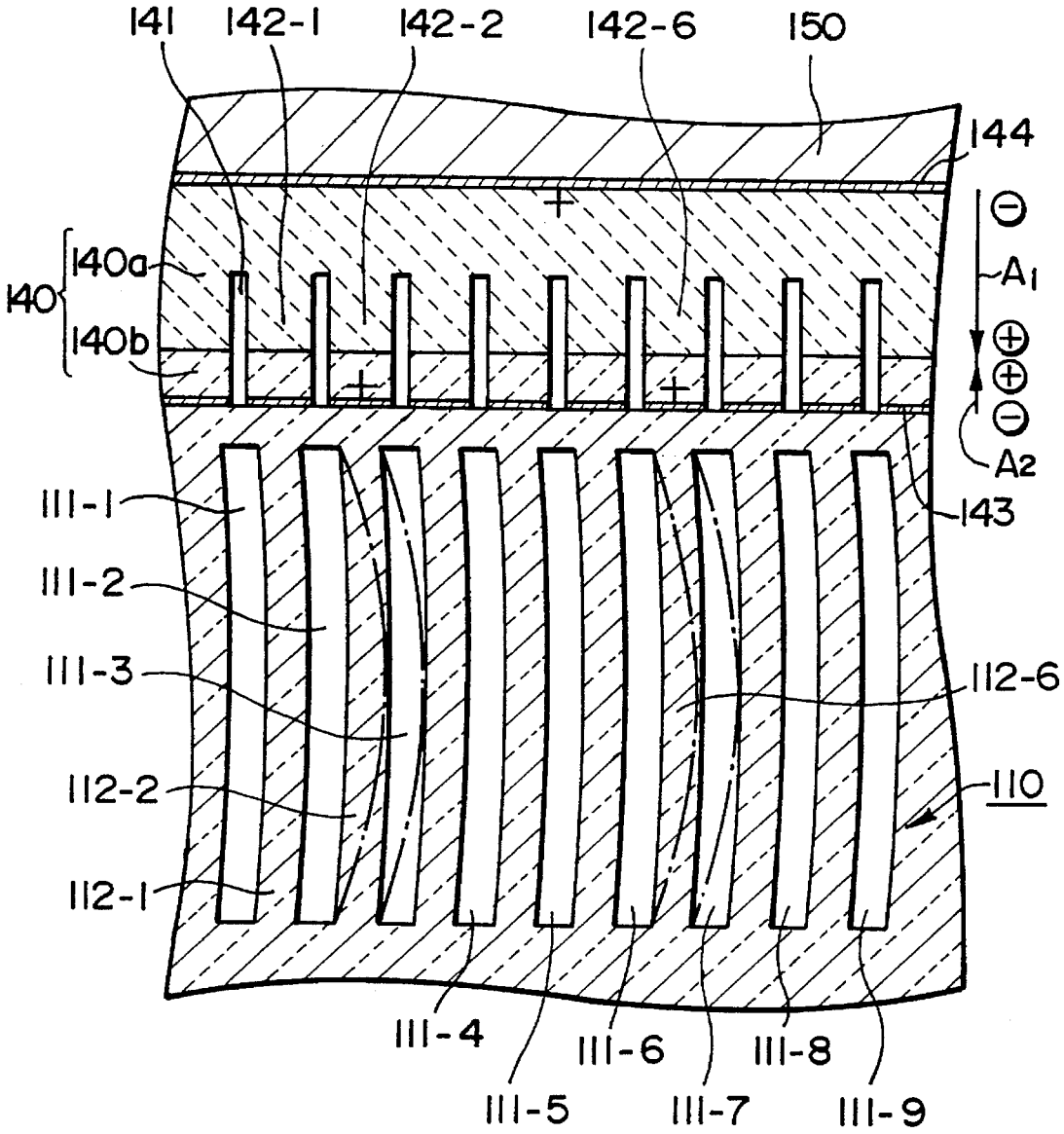
FIG. 4 shows an ink jet print head according to a second embodiment, and particularly multiple ink channels of a diaphragm array and a piezoelectric actuator.

FIG. 4 shows the second embodiment of this invention. As the basic construction of this embodiment is similar to that of the first embodiment of FIG. 3, the corresponding parts or elements are designated in FIG. 4 by adding 100 to like reference numerals in FIG. 3 and their detailed description is omitted here for brevity.

As a significant feature of the second embodiment, although the diaphragm array 110 is Identical with that of the first embodiment, the piezoelectric actuator 140 has a double-layer piezoelectric structure whose direction of polarization is different from that of the first embodiment.

The piezoelectric actuator 140 includes a first piezoelectric film 140*a* whose movement is suppressed at one side by a stationary plate 150, and a second piezoelectric film 140*b* laminated over the first piezoelectric film 140*a* and disposed, at one end, against the end wall 113 of the diaphragm array 110. A common electrode 144 is formed on the stationary-plate side of the first piezoelectric film 140*a*, while individual electrodes 143 are formed on the end surfaces of the diaphragm-array side of the second piezoelectric film 140*b* in confronting relation to the respective partitions 112.

As is apparent from FIG. 4, the resulting laminate of the first and second piezoelectric films 140*a*, 140*b* is divided into individual piezoelectric elements.

The first and second piezoelectric films 140*a*, 140*b* are polarized in opposite polarities in the directions of arrows A1, A2 in FIG. 4.

With the arrangement of the second embodiment, since a bending action is given to the selected partition 112 by the piezoelectric actuator 140, a positive voltage will be impressed to both the common electrode 144 and the individual electrode 143. As a result, similarly to the first embodiment, the selected individual piezoelectric device 142 will expand vertically in FIG. 4 by the piezoelectric action opposite to the direction of polarization of itself so that a desired bending force will be given to the corresponding partition 112.

The second embodiment is advantageous in that the ink jetting action can be controlled as desired only by the application of a positive voltage, that the drive circuit can be simplified and that no electrostatic charge will remain on the print head.

Figure 5:
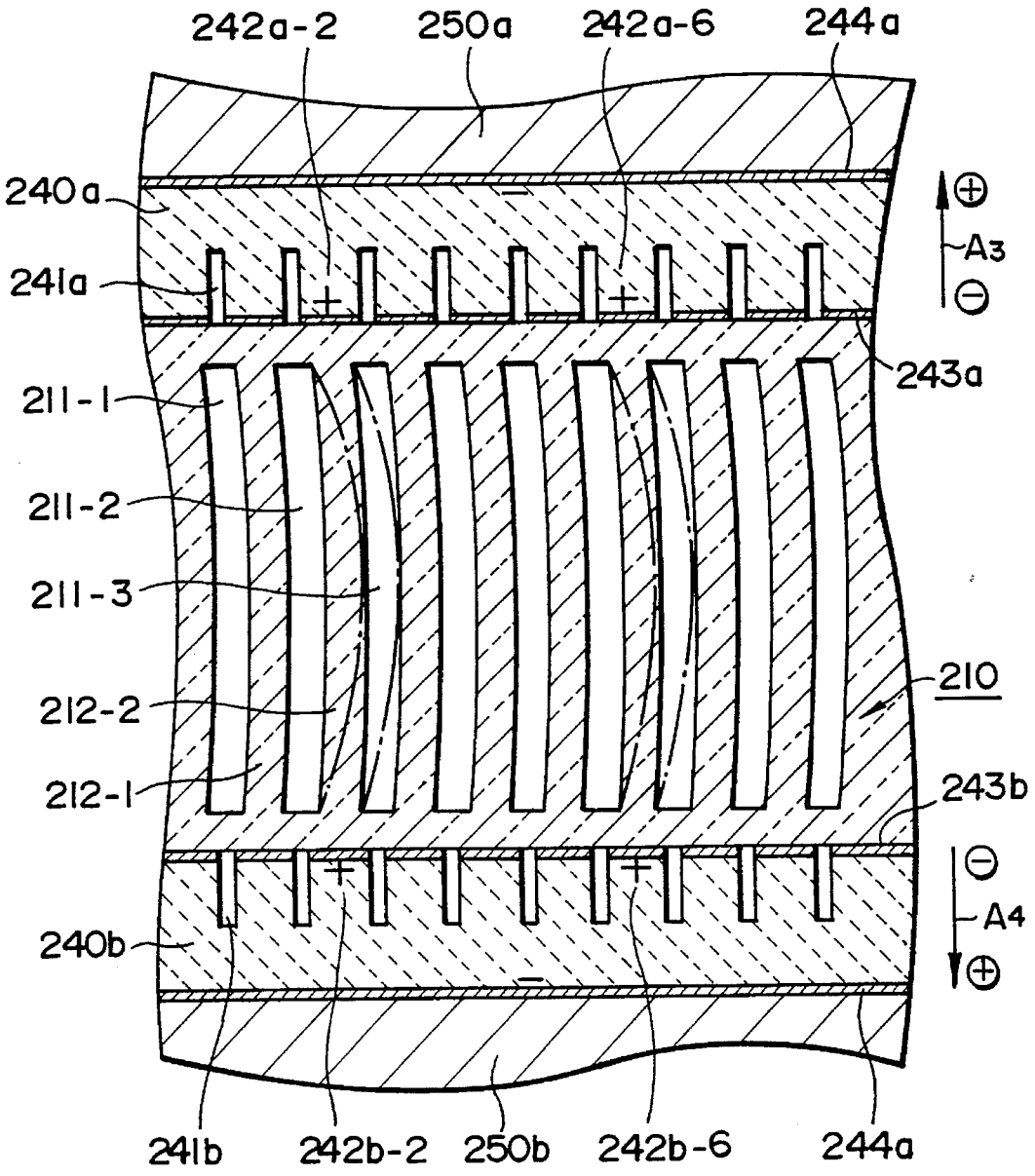
FIG. 5 shows an ink jet print head according to a third embodiment, and particularly a diaphragm array and a pair of piezoelectric actuators formed at opposite sides of the diaphragm array.

FIG. 5 shows the third embodiment of this invention. As the basic construction of this embodiment is similar to that of the first embodiment of FIG. 3, the corresponding parts or elements are designated in FIG. 5 by adding 200 to like reference numerals in FIG. 3, and their detailed description is omitted here for brevity.

As a significant feature of the third embodiment, a pair of piezoelectric actuators 240*a*, 240*b* are disposed outwardly of the opposite end walls 213, 214 of the individual partition 12 in order to increase the extent to which the individual partition 212 of the diaphragm array 210 may be bent. These two piezoelectric actuators 240*a*, 240*b* are identical in structure with the piezoelectric actuator 40 of the first embodiment, and their respective directions of polarization are indicated by arrows A3, A4 in FIG. 5.

If the selected individual partition 212 is bent from the opposite end walls 213, 214 by the piezoelectric actuators 240*a*, 240*b* even if the movement of the single piezoelectric actuator 240 is reduced by half, compared to the foregoing embodiments, it is possible to bend the partition 212 to the same extent as in the foregoing embodiments.

In FIG. 5, for the partitions 212-2, 212-6 selected by the piezoelectric actuators 240*a*, 240*b*, a positive voltage is applied to the individual electrodes 243*a*-2, 243*a*-6 of the upper individual piezoelectric elements 242*a*-2, 242*a*-6 and the individual electrodes 243*b*-2, 243*b*-6 of the lower individual piezoelectric elements 242*b*-2, 242*b*-6. Meanwhile a negative voltage is applied to the respective common electrodes 244*a*, 244*b* of the upper and lower piezoelectric actuators 240*a*, 240*b*.

Thus when the selected partitions 212-2, 212-6 are bent as indicated by phantom lines in FIG. 5, ink will be sucked into the ink channels 211-2, 211-6 each disposed at the convex side of the respective partition. Now when the applied voltage to the two piezoelectric actuators 240*a*, 240*b* is removed after ink has been sucked in completely, the two partitions 212-2, 212-6 will be suddenly returned to their original postures, thereby jetting the ink in the ink channels 211-2, 211-6 towards the paper.

According to the third embodiment, the extent of movement of each piezoelectric actuator 240*a*, 240*b* may be small, or the curvature of the partition 212 may be large. Further, since the partition 212 is compressed longitudinally from opposite ends, it is possible to achieve a high-speed response.

Figure 6:
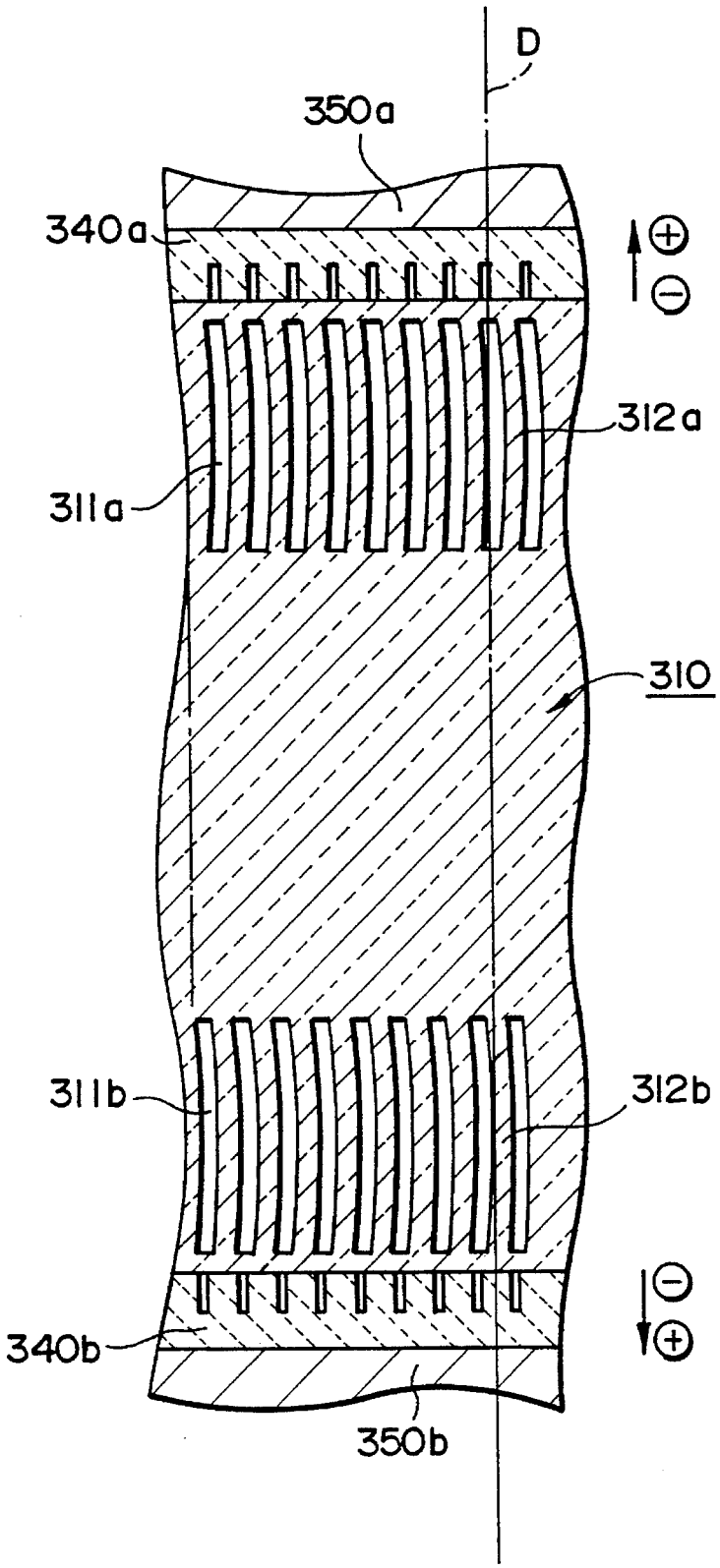
FIG. 6 shows an ink jet print head according to a fourth embodiment, particularly a pair of diaphragm arrays and a pair of piezoelectric actuators.

FIG. 6 shows the fourth embodiment; parts or elements corresponding to those of the first embodiment are designated by adding 300 to like reference numerals in FIG. 3 and their detailed description is omitted here for brevity.

As a significant feature of the fourth embodiment, the diaphragm array 310 includes two separate arrays of ink channels. The individual ink channels of one array are deflected from those of the other array by a ½ pitch so that half dot printing can be performed. Therefore it is particularly easy to achieve a high-density print head; in FIG. 6, for example, sixty-four nozzles of 360DPI are realized. In the fourth embodiment, the ink channels of each of the upper and lower arrays are identical in structure and operation with those of the first embodiment, and so ink can be jetted from the selected ink channels.

In any of the foregoing embodiments, the piezoelectric actuator gives a compressing action to the corresponding partition, depending on the direction of polarization, the polarity of the applied voltage and the value of the applied voltage. During this bending of the partition, a desired amount of ink will be sucked into the ink channel at the concave side of the partition. Then when the applied voltage is removed, ink will be jetted by the restoring action of the partition. For returning the partition at a greater speed, it is also preferable to invert the polarity of the voltage to be applied to the piezoelectric actuator.

Further, since to change the volume of the ink channel, the partition extends lengthwise, as indicated by H in FIG. 2, perpendicularly to the widthwise direction W of the ink channel 11 which extends from the ink supply inlet 31 toward the orifice 21, it is possible to restrict the width W of the ink channel 11 to a relatively short width, even though H is large, to obtain a good bending action of the partition. It is thereby possible to shorten individual ink channels so that high-viscosity ink can be used.

FIGS. 7 through 10 show a print head according to the fifth embodiment of this invention.

Figure 7:
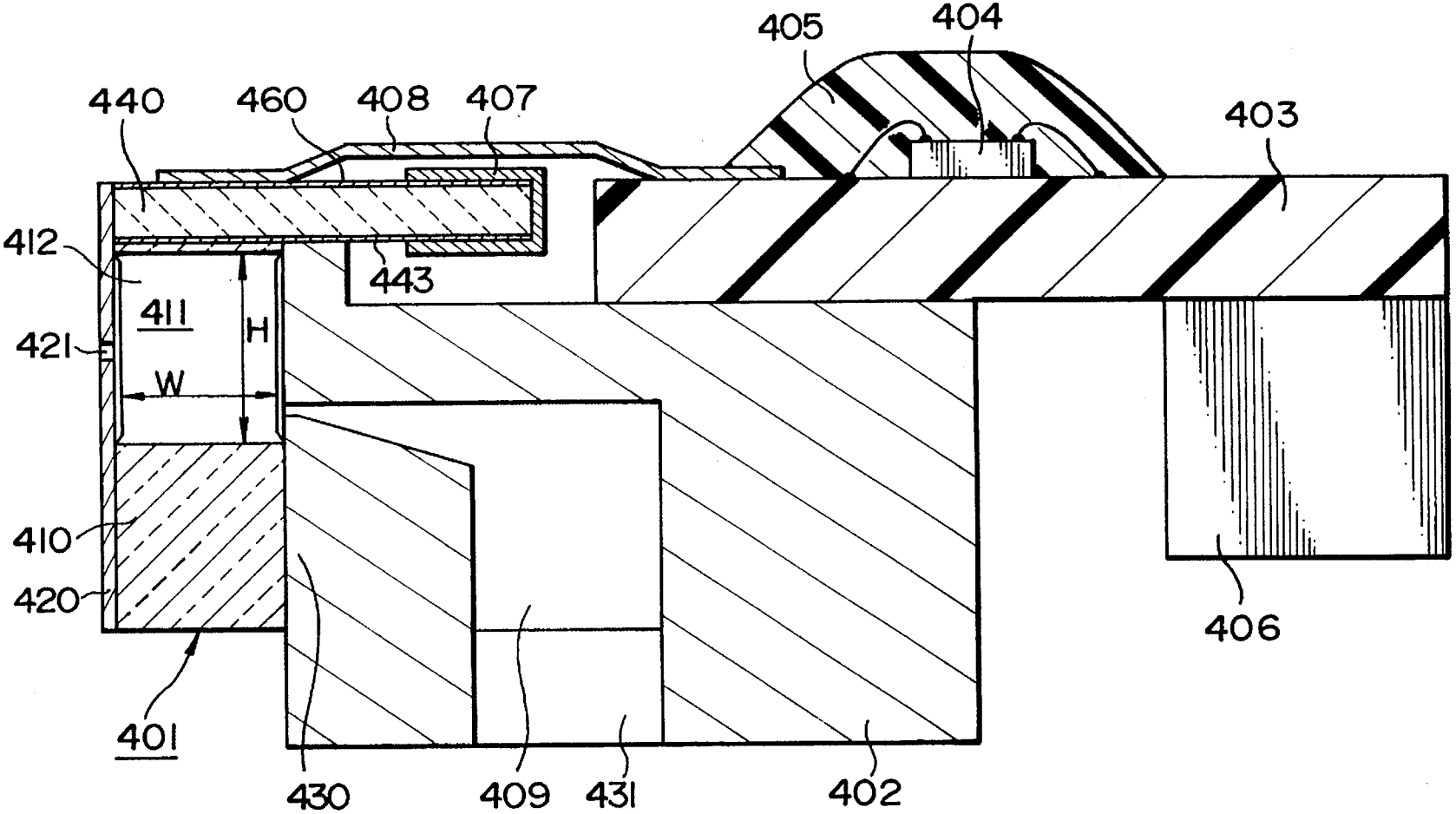
FIG. 7 is a side cross-sectional view of a line-type jet print head according to a fifth embodiment.

In FIG. 7, the print head 401 comprises a diaphragm array 410, an orifice board 420, a back board 430 and a piezoelectric actuator 440. In this embodiment, the back board 430 of the print head 401 is formed integrally with an ink-channel block 402 having an ink supply channel 409 which is connected to a known ink source which is not illustrated in the drawing via an ink supply inlet 431, the ink supply channel 409 communicating with the individual ink channels 411.

To the ink-channel block 402 a circuit board 403 is fixed, on which a driver IC 404 is mounted. The circuit board 403 is covered with a protective coating 405. The circuit board 403 is provided at Its lower rear portion with a connector 406 for external connection.

Figure 8:
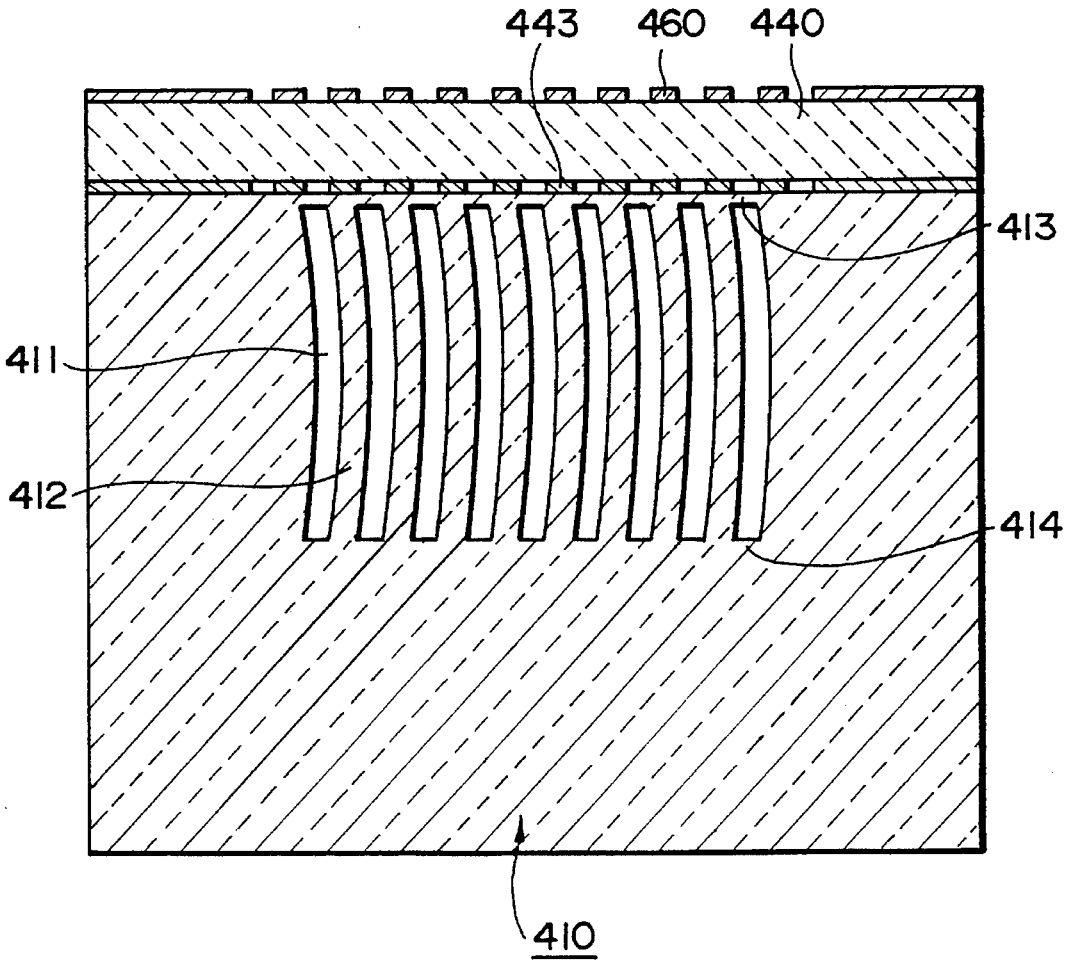
FIG. 8 is a front cross-sectional view of a main portion of the print head of the fifth embodiment, showing the diaphragm array and the piezoelectric actuator from the side of a printing paper.

FIG. 8 shows the diaphragm array 410 and the piezoelectric actuator 440 in detail. The diaphragm array 410 includes a group of orderly arranged ink channels formed of photosensitive glass by a delicate etching process. The ink channels 411 are defined by bendable curved partitions 412. The individual partitions 412 are bridged at their upper ends and at their lower ends by an upper end wall 413 and a lower end wall 414, respectively. The structure of this diaphragm array 410 is identical with that of the foregoing embodiments.

As is apparent from FIG. 7, the ink channels 411 are closed at the front side by the orifice board 420 and at the rear side by the back board 430. Since there is a small gap between the orifice board 420 and each partition 412 and between the latter and the back board 430, the partition 412 can be bent freely by buckling.

The orifice board 420 has orifices 421 communicating with the individual ink channels 411. The partitions 412 are such that each partition 412 is bendable freely and that each partition 412 has a height H larger than the width W so as to prevent jamming in the ink channels 411 even if high-viscosity ink is used.

As a significant feature of this embodiment, the piezoelectric actuator 440, unlike the foregoing embodiments, does not have a stationary plate that would have restricted the movement of the individual partition at the side opposite to the diaphragm array. So the piezoelectric device confronting the individual partition 412 is moved vertically in the shearing mode between the adjacent piezoelectric devices.

As shown in FIG. 8, the piezoelectric actuator 440 includes a film-like piezoelectric device, and a plurality of sets of upper and lower common electrode pairs 443, 460 on opposite side surfaces of the piezoelectric device, namely, on one side surface confronting the diaphragm array 410 and the upper free surface confronting the individual partition 412. The electrode pairs 443, 460 are metal electrodes evaporated over opposite surfaces of a piezoelectric member made of a material such as lead zirco-titanate.

The upper and lower electrodes are a vertical pair confronting the individual partition 412, the piezoelectric device 440 being fixedly adhered to the diaphragm array 410 with the lower electrodes 443 sandwiched therebetween.

On the opposite surface of the piezoelectric device confronting the lower individual electrode 443, the upper individual electrode 460 is evaporated.

In this embodiment, when the same polarity voltage, which is opposite to the polarity of the adjacent electrodes, is applied to the upper and lower electrodes 443, 460 confronting a pair of partitions 412, the piezoelectric device will be moved vertically in a desired shearing mode. During the piezoelectric driving, the same polarity voltage is applied to tile pair of electrodes 443, 460 confronting the individual partition. For this purpose, as shown in FIG. 7, the two electrodes 443, 460 are connected to the circuit-board-side rear end of the piezoelectric device 440 by a common flexible cable 407. The piezoelectric device of lead zirco-titanate preferably has such a size that it projects rearwardly from the diaphragm array 410 to the common connection by the flexible cable 407. A flexible cable 408 is connected at one end to the upper individual electrode 460 for supplying a drive voltage from the driver IC 404 to a desired electrode pair.

The ink jetting action of the fifth embodiment will now be described in detail, concentrating on the operation of the piezoelectric actuator 440.

Figure 9:
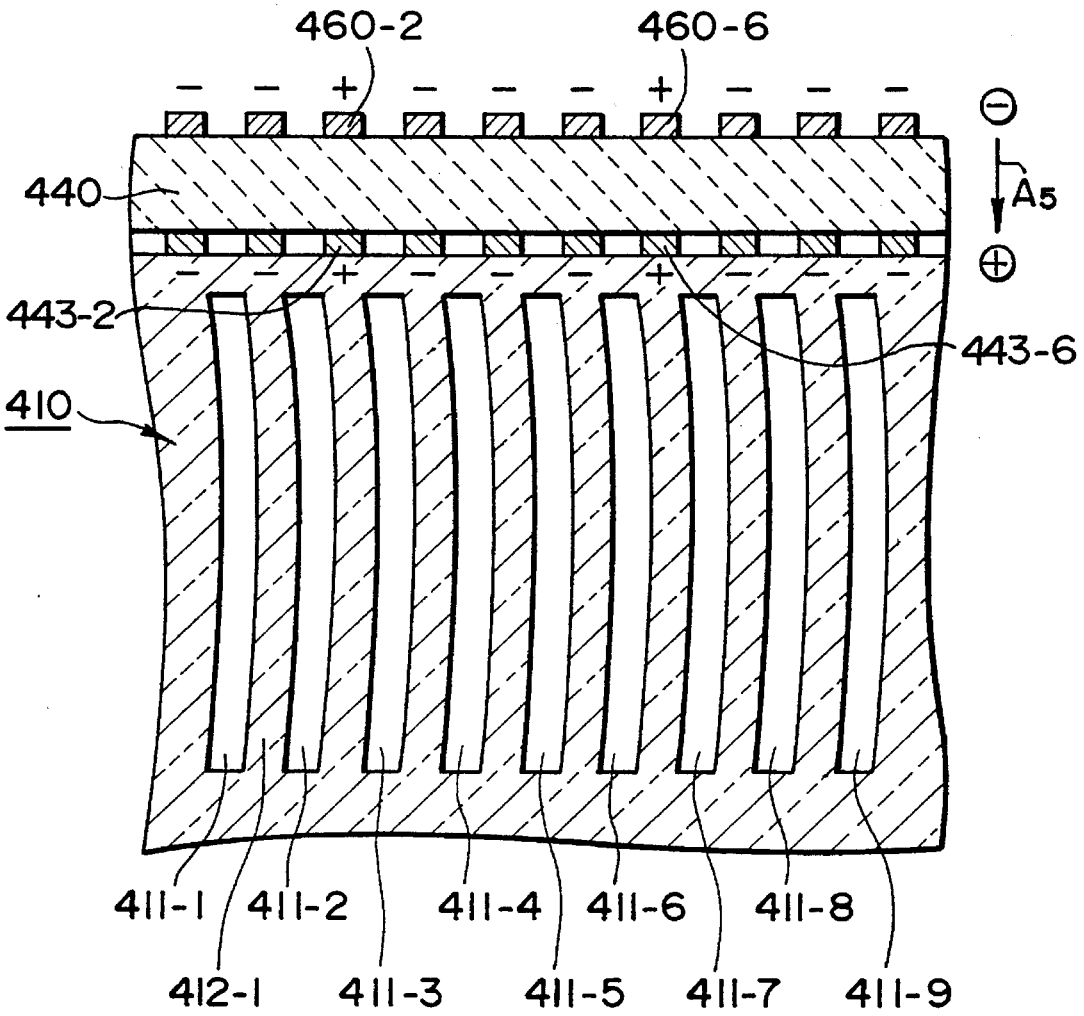
FIG. 9 is an enlarged cross-sectional view of FIG. 8.

The piezoelectric device 440 is polarized at the free side negatively and at the side toward the diaphragm array 410 positively, as indicated by an arrow A5 in FIG. 9.

In the fifth embodiment, unlike in the foregoing embodiments, since the piezoelectric actuator 440 is free at the upper side, the individual piezoelectric device can work only at the free upper side even if a voltage is applied to the selected individual electrode pair in the direction different from the above-mentioned direction of polarization, thus giving no driving force to the partition 412 of the diaphragm array 410.

When voltages of different polarities are applied to the selected individual electrode pair and its adjacent pairs, a shearing drive force will be given between the adjacent piezoelectric device and the selected individual piezoelectric device to move the desired individual piezoelectric device in a predetermined direction, e.g., in the direction of the diaphragm array 410, thus giving a bending force to the desired partition 412 by buckling.

Now assume that ink is jetted from, for example, two ink channels 411-2,411-6 of nine ink channels 411. The partitions 412-2, 412-6 having the selected ink channels 411-2, 411-6 on the concave side have to be bent by buckling. For this purpose, as shown in FIG. 9, a positive driving voltage is applied to the individual electrode pairs 443-2, 460-2 and 443-6,460-6 confronting the partitions 412-2, 412-6, and a negative driving voltage is applied to every other individual electrode 443, 460. As a result, a deformation in the shearing mode will develop on the piezoelectric device 440 at a portion where the polarity of the applied voltage is different so that the individual piezoelectric device to which a voltage having a polarity different from the polarity of the contiguous portion will be sheared in the direction of the diaphragm array 410, as shown in FIG. 10.

Figure 10:
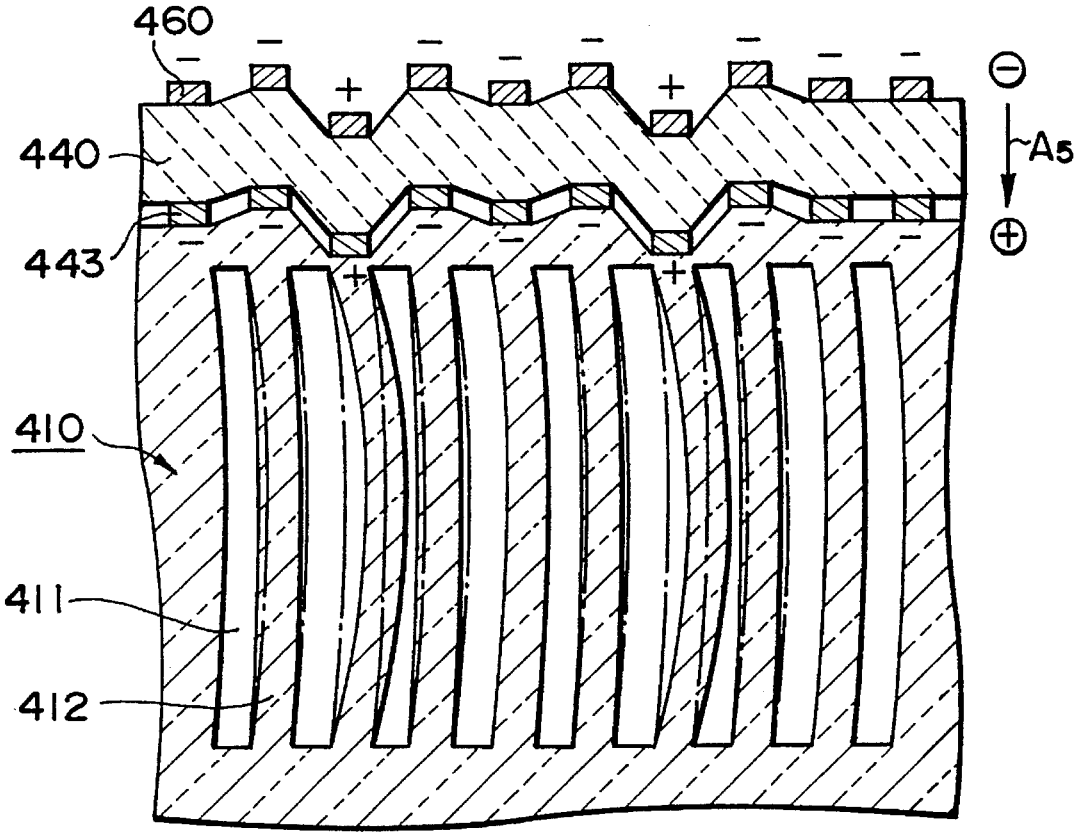
FIG. 10 illustrates the ink jetting action of the print head of the fifth embodiment.

As is apparent from FIG. 10, the piezoelectric device areas of the individual electrode pairs 443-2, 460-2 and 443-6,460-6 will be lowered toward the diaphragm array 410, and reversely the piezoelectric device areas defined by these adjacent individual electrode pair will be deformed slightly upwardly.

This shearing deformation gives a bending action to the selected partitions 412-2,412-6 by buckling.

Also in this embodiment, the partition 411 is curved in a predetermined direction so that it can be buckled in a constant direction by the piezoelectric actuator 440 and hence can be bent with ease. This makes the response speed of the partition 412 much higher so that ink can be jetted at a markedly high speed when the partition restores to its original posture after the suction of ink into the ink channels and the removal of a driving voltage.

With the fifth embodiment, since the piezoelectric actuator 440 is glued onto the diaphragm array 410 without using the stationary plate of the foregoing embodiments, it is possible to downsize the print head for use in various types of printers.

FIGS. 11 through 14 show the sixth embodiment of this invention. As a feature of this embodiment, the diaphragm array is formed of a piezoelectric material. Drive electrodes are glued directly onto the curved partition of the piezoelectric diaphragm array.

Figure 11:
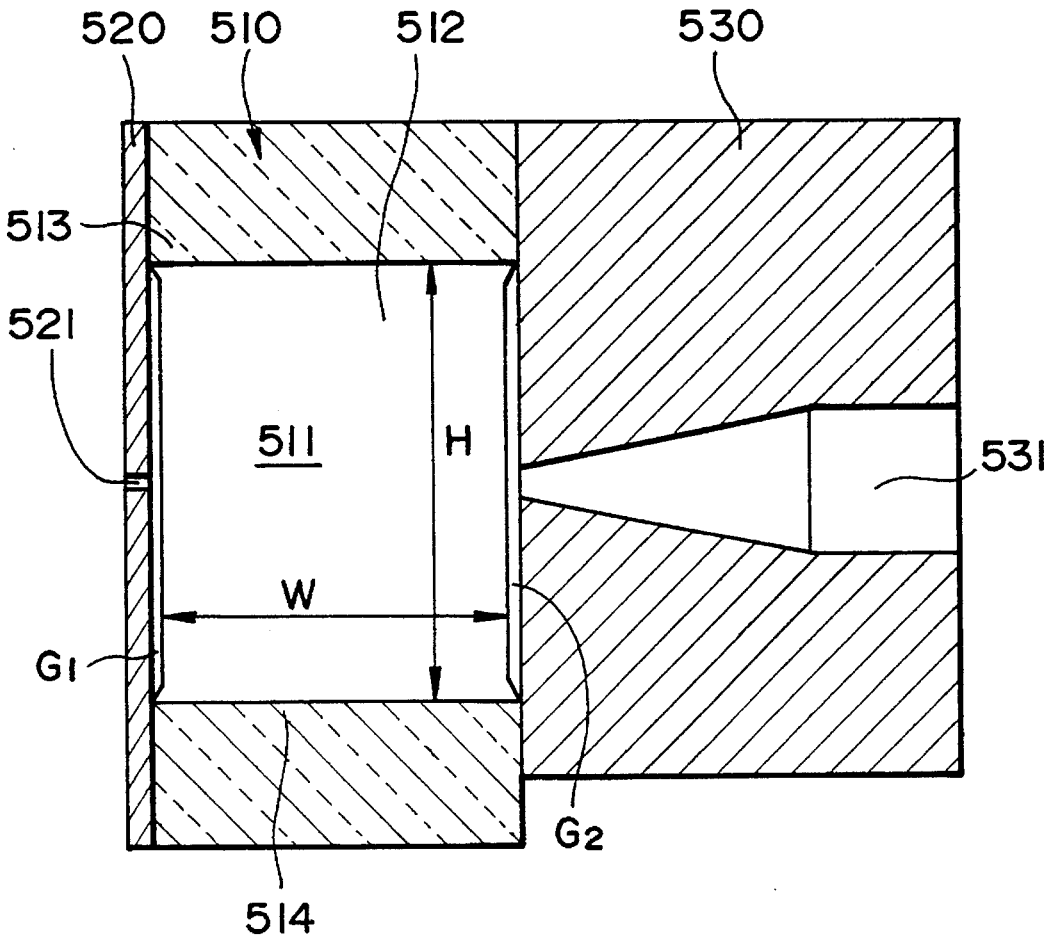
FIG. 11 is a side cross-sectional view of an ink jet print head according to a sixth embodiment, showing a main portion of the print head.

FIG. 11 is a fragmentary schematic cross-sectional view showing a print head of this embodiment, with a circuit board and other parts being omitted.

As in the foregoing embodiments, the piezoelectric diaphragm array 510 includes a group of orderly arranged ink channels. As is apparent from FIGS. 11 and 12, the ink channels designated by reference numeral 511 are defined by bendable curved partitions 512 arranged in such a manner that every partition is convex in one direction. The partitions 512 are bridged at upper ends and lower ends by an upper end wall 513 and a lower end wall 514, respectively.

To close the ink channels 511, one surface of each of the upper and lower end walls 513, 514 of the diaphragm array 510 is fixed to an orifice board 520. The orifice board 520 has orifices 521 communicating with the individual ink channels 511 so that ink thrust from the corresponding ink channel 511 may be jetted to a paper via the orifice 521.

Also in this embodiment, for the partition 512 to bend between the upper and lower end walls 513, 514 easily, there is defined a small gap G1 between the partition 512 and the orifice board 520. Generally, the length of the gap G1 is about 0.5 μm so that ink in the individual ink channel 511 is prevented as much as possible from leaking into the adjacent ink channels.

The back board 530 is disposed on the rear side of the diaphragm array 510 and is fixed to the other surface of each of the upper and lower end walls 513, 514 of the diaphragm array 510. The back board 530 has a ink supply inlet 531 so that ink from an non-illustrated ink source can be supplied to the individual ink channel 511.

There is also defined a small gap G2 between the back board 530 and the partition 512 so that the bending movement of the partition 512 is prevented from being obstructed by the back board 530. As in the foregoing embodiments, the individual ink channel 511 and the individual partitions 512 of the sixth embodiment are curved in a common direction as shown in detail in FIG. 12, thus facilitating the bending action of the individual partition 512.

Figure 12:
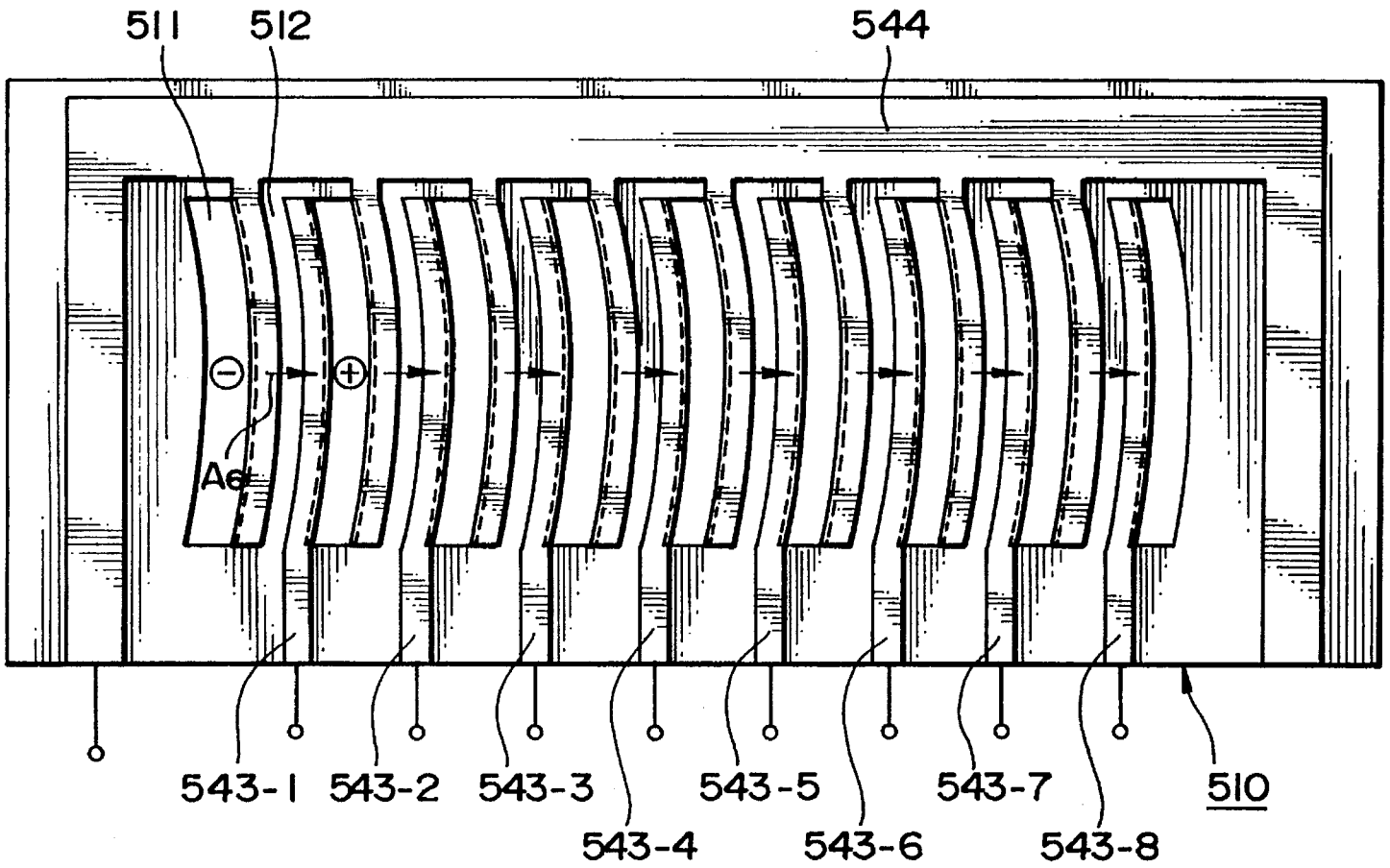
FIG. 12 is a front cross-sectional view showing a piezoelectric diaphragm array and electrodes of the print head of the sixth embodiment from the side of a printing paper.
Figure 13:
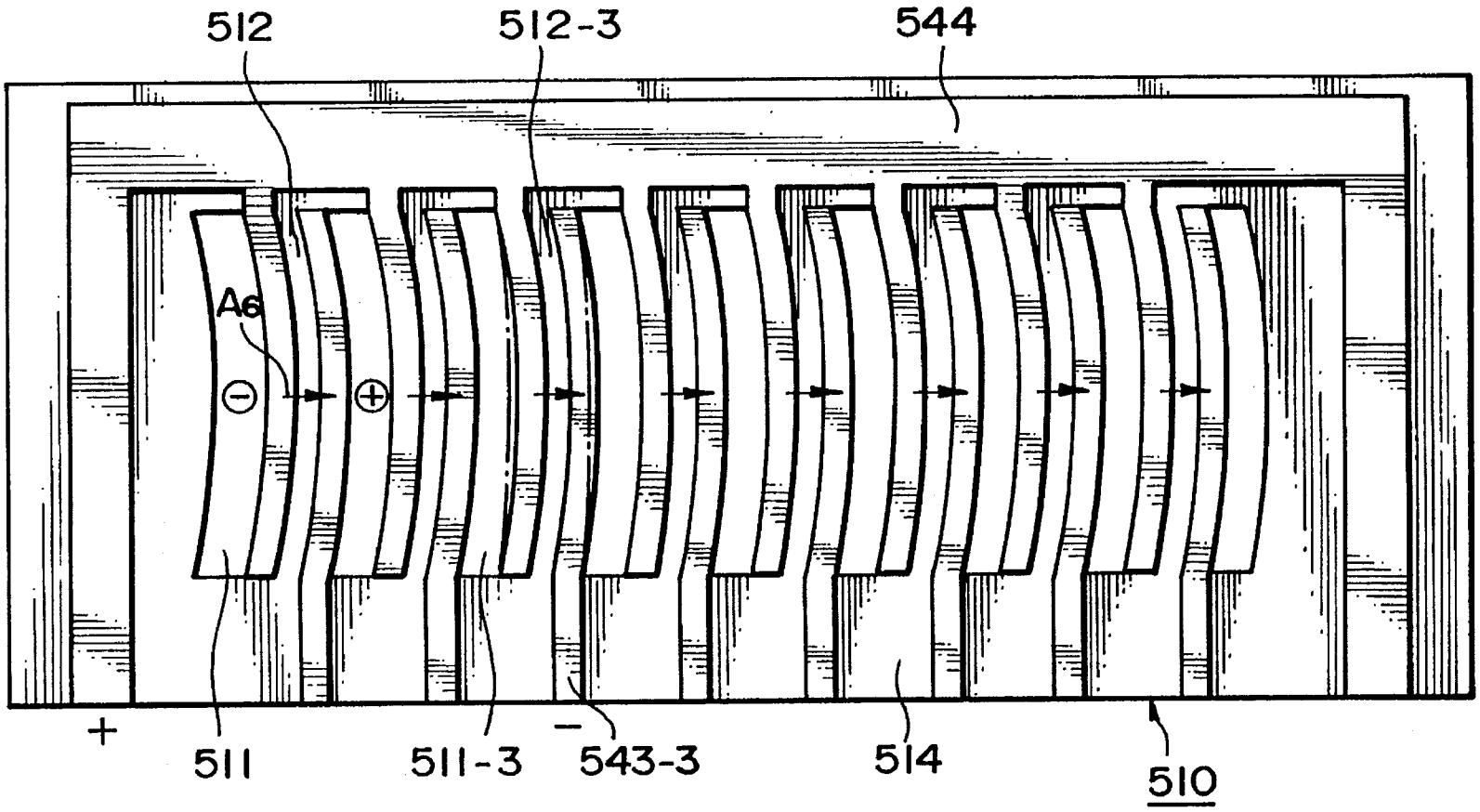
FIG. 13 illustrates an ink jetting action of the print head of the sixth embodiment.

The diaphragm array 510 itself is formed of a piezoelectric material, and the plural partitions 512 are polarized at the concave side negatively and at the convex side positively, as indicated by an arrow A6 in FIGS. 12 and 13.

Therefore, by applying a voltage to the partition 512 in a predetermined direction, it is possible to bend the partition 512 in a direction determined by the direction of polarization and the polarity of the applied voltage. This bending of the partition 512 changes the volume of the adjacent ink channels 511 to suck ink into a desired ink channel. As with the foregoing embodiments, when the partition 512 is returned to its original position upon removal of the applied voltage, ink will be thrust out from the ink channel and will then be jetted to the paper via the orifice 521.

The electrodes of the piezoelectric array 510, as shown in FIG. 12, are glued to the opposite surfaces of each partition 512, i.e. along the inside wall surfaces of the individual ink channel. These electrodes are formed preferably by being evaporated onto every surface of the diaphragm array 510 of a piezoelectric material such as lead zirco-titanate, particularly on the inside wall surfaces of the ink channel 511 and then removing unnecessary portions by etching.

In FIG. 12, a common electrode is formed on the concave surface of each partition 512, while an individual electrode is formed on the convex surface of each partition 512. Though it is not apparent from FIG. 12, the common electrode 544 and the individual electrode 543 lead to the rear surface of the piezoelectric diaphragm array 510 and are electrically connected with a non-illustrated circuit board by, for instance, flexible cables.

The ink jetting action of the sixth embodiment will now be described.

In this embodiment, like the foregoing embodiments, when the selected partition 512 is bent, ink will be sucked into the ink channel 511 disposed at the concave side of the partition 512, and when the partition 512 is returned to its original position, ink thrust from the fully filled ink channel will be jetted toward the paper via the corresponding orifice 521.

The diaphragm array 510 including the partitions 512 is formed of a piezoelectric material; when a voltage is applied to the common and individual electrodes evaporated on the opposite inside wall surfaces of the individual partition 512, the selected partition 512 will be deformed to bend easily.

FIG. 13 illustrates an example in which the partition 512-3 is bent. The partition 512 is previously polarized at the concave side negatively and at the convex side positively; in this condition, a positive voltage is applied to the common electrode 544 and, on the other hand, a negative voltage is applied to the individual electrode 543-3 of the selected partition 512-3. Upon application of voltage according to this polarity, the partition 512 will be compressed longitudinally by the piezoelectric action to bend so as to reduce its curvature, as indicated by phantom lines in FIG. 13. This bending deformation causes the ink channel 511-4 to increase its volume so that ink is sucked into the ink channel. Meanwhile the ink channel 511-3 at the concave side of the partition 512-3 is reduced in volume; however, since there is only a small amount of ink remaining in the ink channel in the initial state, ink will not be jetted outwardly from the ink channel 511-3.

Then, when the voltage applied between the two electrodes is removed after the selected partition 512-3 has been adequately bent, the partition 512-3 will be returned to the position indicated by solid lines in FIG. 13. As a result, the ink which now fills the ink channel 511-4 will be thrust from the ink channel and will be jetted toward the paper via the orifice 521. By applying voltages of different polarities to the opposite electrodes 544, 54-3 during this voltage removal stage, it is possible to speed up the returning action of the partition 512-3. During this application of voltages of opposite polarities, the partition 512-3 will be expanded longitudinally and will hence be deformed in such a direction as to increase the curvature.

The ink jetting action may be performed by causing the partition 512 to restore or expand from the compressed posture, and vice versa.

Since the diaphragm array 510 itself is formed of a piezoelectric material, it is possible to obtain a desired bending deformation only by providing electrodes on the opposite side surfaces of the partition, and it is possible to control ink to be jetted from the ink channels.

The process of manufacturing the piezoelectric diaphragm array will now be described in brief.

Firstly a suitable piezoelectric material is molded and sintered to form a plate-like array blank. Then a plurality of curved ink channels are formed at predetermined distances in and along the array blank such as by an EXCIMER laser process or a molding process. As a result, a plurality of partitions are formed between the adjacent individual ink channels and are bridged at their upper ends and their lower ends by an upper end wall and a lower end wall, respectively. Then electrodes are evaporated onto the surfaces of the piezoelectric diaphragm array by evaporation technique such as sputtering, whereupon unnecessary electrode portions are removed by mask patterning and etching. Thus a common electrode and individual electrodes, as shown in FIG. 12, are obtained.

After desired electrodes are formed on the piezoelectric diaphragm array, the piezoelectric device is polarized. For this polarization, a positive voltage is applied to the common electrode, and a negative voltage is applied to all of the electrodes.

Figure 14:
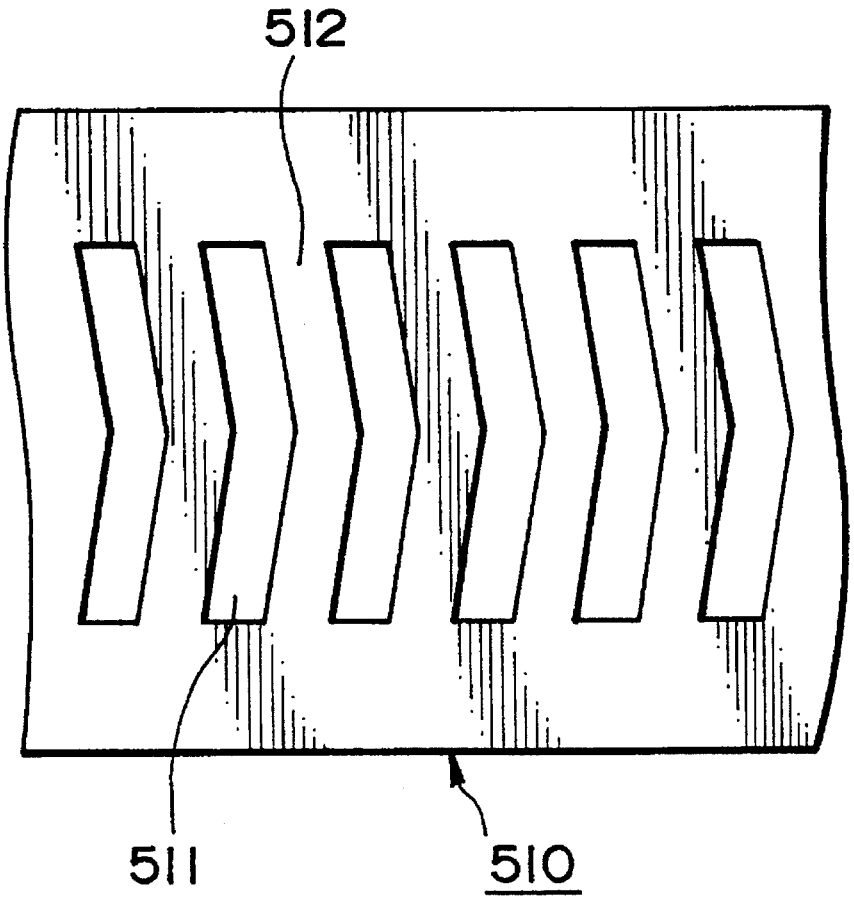
FIG. 14 shows a modified form of ink channels and partitions of the sixth embodiment.

In this embodiment, the individual partitions are curved. This invention should by no means be limited to this specific example and may be a V shape as shown in FIG. 14.

Preferably the common electrode and the individual electrodes are covered, at portions confronting the inside walls of the ink channels, with a protective coating for preventing the electrodes from being by the ink.

Figure 15:
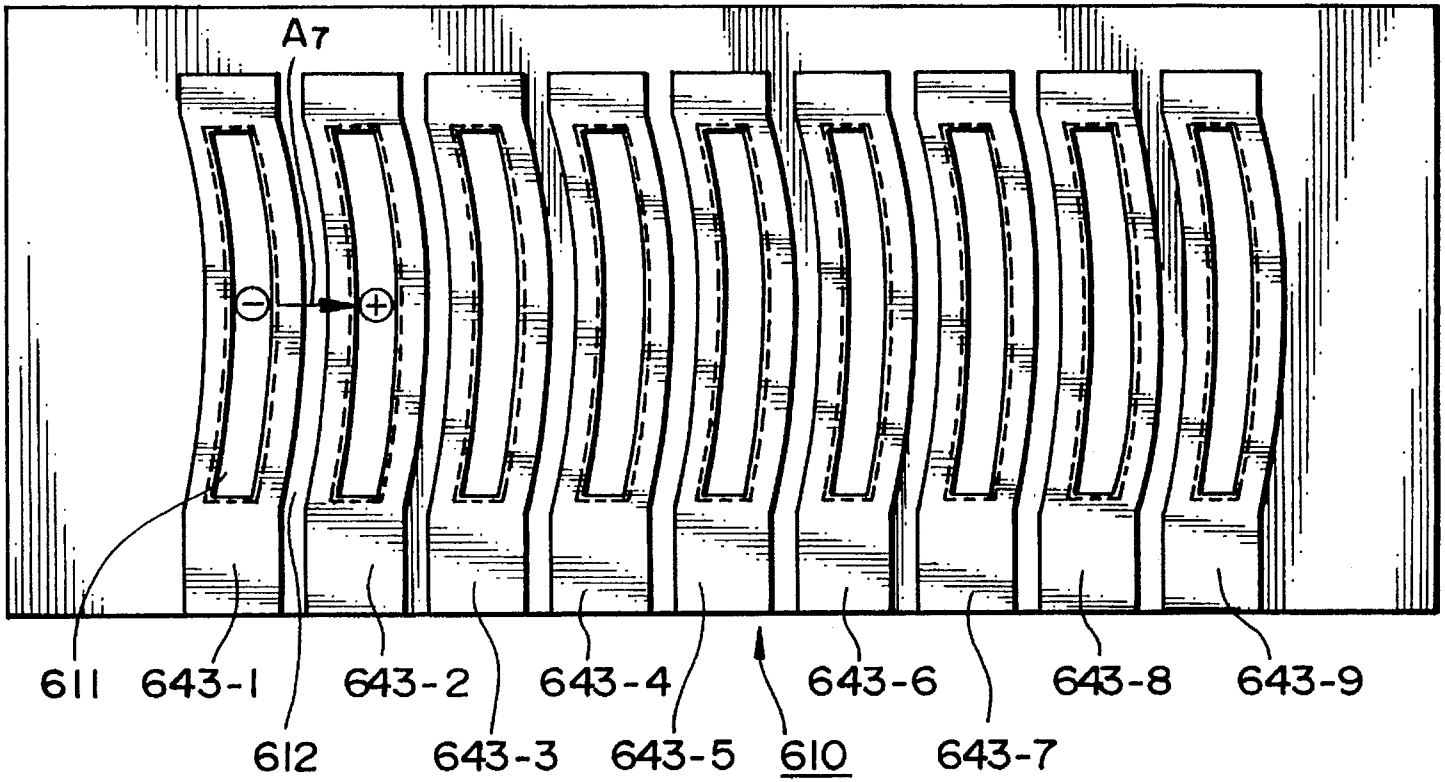
FIG. 15 shows an ink jet print head according to a seventh embodiment, illustrating relative positions of a piezoelectric diaphragm array and electrodes.

FIG. 15 shows an ink jet print head according to the seventh embodiment of this invention. Because this embodiment is similar to the sixth embodiment, the similar parts or elements are designated by adding 100 to like reference numerals of the sixth embodiment, with their detailed description being omitted for brevity.

In this embodiment, like the sixth embodiment, the diaphragm array 610 itself is formed of a piezoelectric material and has a plurality of ink channels 611 defined by an array of orderly arranged arcuate partitions 612.

The seventh embodiment is only different from the sixth embodiment in the electrode structure with respect to the piezoelectric diaphragm array 610. In this electrode structure, as is apparent from FIG. 15, the individual electrodes 643 are formed on all the inside walls of the ink channels 611. On the curved inside walls of the ink channels 611, the electrodes 643 of the same potential are evaporated.

With this electrode arrangement, voltages are applied to the convex side and the concave side of each partition 612 by the adjacent different individual electrodes 643.

The ink jetting action of this embodiment will now be described in detail.

Figure 16:
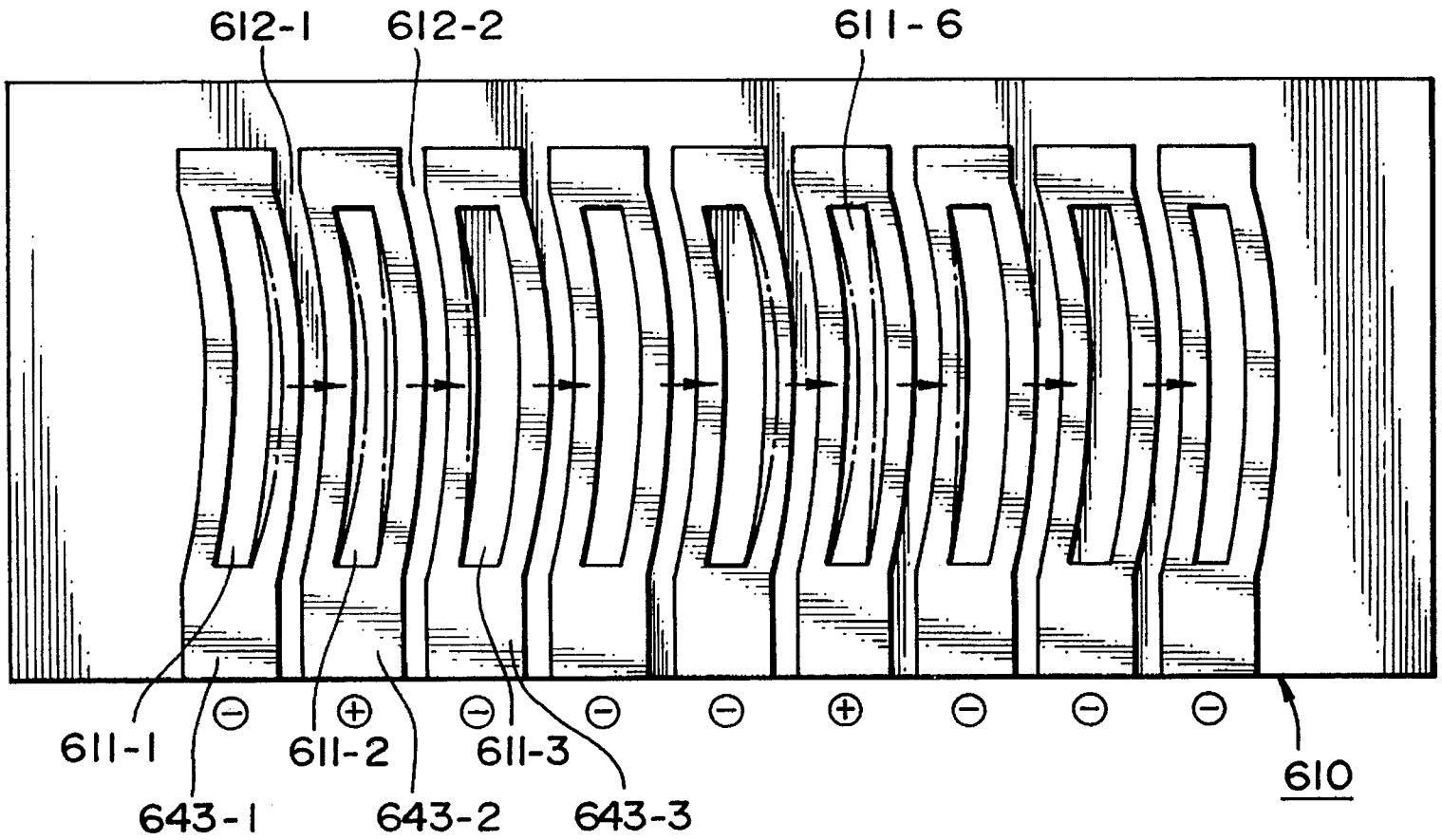
FIG. 16 illustrates the ink jetting action of the print head of the seventh embodiment.

As shown in FIGS. 15 and 16, the piezoelectric diaphragm array 610 is polarized at the convex side of the individual partition 612 positively and at the concave side of the individual partition 612 negatively as indicated by an arrow A7.

As shown in FIG. 16, a positive or a negative voltage is applied to each individual electrode 643. In this embodiment, a positive voltage is applied to the individual electrodes 643-2,643-6 of the ink channels 611-2, 611-6 for jetting ink, and a negative voltage is applied to every other individual electrode 643. By this voltage polarity, the partition 612-1 at the left side (FIG. 16) of the ink channel 611-2 is bent so as to increase its curvature, and the partition 612-2 at the right side of the ink channel 611-2 is bent to reduce its curvature. As a result, the volume of the ink channel 611-2 is reduced so that ink filled in the ink channel 611-2 will be thrust toward the paper via the orifice.

This ink jetting action can be performed also in the ink channel 611-6, and so ink can be jetted from any selected ink channel as desired.

When the applied voltage to the individual electrode is removed after the ink jetting has been completed, the partition 612 will restore to the posture of FIG. 15 to vary the volumes of the ink channels 611-2, 611-6 so that the ink channels will be filled with ink from the ink source.

According to this invention, it is possible to achieve an energy-saving small-size ink jet printer in which since when the partition is bent to change the volume of the arcuate ink channel of the diaphragm array, the volume of the ink channel can be changed greatly by a small longitudinal movement of the partition.

In this invention, partly since ink sucking and jetting can be performed by varying the curvature of the partition, partly since the polarity of the impressed voltage can be selected optitionally and partly since the voltage application and removed are combined, it is possible to realize an effective ink jetting action.

It is also possible to guarantee high-density printing and high printing quality easily by a small-size print head.

Further, partly since the diaphragm array has the ink channels formed of photosensitive glass or a piezoelectric material by etching or by laser processing, respectively, it is possible to obtain a diaphragm array at an improved rate of production. In the laser processing, a piezoelectric material such as lead zirco-titanate in a KOH solution is processed by the laser.

Furthermore, partly since suction of ink and jetting of ink are controlled by bending the partitions, and partly since the volume of the ink channel depends on the length of the partition while the orifice for jetting ink is formed in the widthwise direction of the ink channel, it is possible to increase the volume of the ink channel only by increasing the length of the partition so that the width of the ink channel can be shortened. As a result, since the width of the ink channel is short, even though high-viscoslty ink is used, it is possible to suppress ink blockages.

By using such a print head in a printer of a word processor, a facsimile machine, a plotter, or the like, it is possible to secure high-quality and high-speed printing.

What is claimed is:

1. An ink jet print head comprising:

(a) a diaphragm array including a group of bending curved partitions, each of said partitions having an upper end and a lower end, the array further including an upper end wall bridging between each said upper end of said partitions, and a lower end wall bridging between each said lower end of said partitions, wherein said upper end wall, said lower end wall and said partitions form ink channels therebetween, said ink channels extending in a first direction and being ordered along a second direction orthogonal to the first direction;

(b) an orifice board fixed to one side of said diaphragm array and facing an end of each of said ink channels, said orifice board having ink jet orifices for fluidly communicating with respective ink channels;

(c) a back board fixed to another side of said diaphragm array and facing another end of each of said ink channels, said back board having ink supply inlets for fluidly communicating with respective ink channels; and (d) a piezoelectric actuator abutting one of the upper end wall and the lower end wall for selectively applying in the first direction a compressing force which causes selected partitions to bend in the second direction.

2. An ink jet print head comprising:

(a) a diaphragm array including a group of bending curved partitions, each of said partitions having an upper end and a lower end, the array further including an upper end wall bridging between each said upper end of said partitions, and a lower end wall bridging between each said lower end of said partitions, wherein said upper end wall, said lower end wall and said partitions form ink channels therebetween, said ink channels extending in a first direction and being ordered along a second direction orthogonal to the first direction;

(b) an orifice board fixed to one side of said diaphragm array and facing an end of each of said ink channels, said orifice board having ink jet orifices for fluidly communicating with respective ink channels;

(c) a back board fixed to another side of said diaphragm array and facing another end of each of said ink channels, said back board having ink supply inlets for fluidly communicating with respective ink channels; and (d) a piezoelectric actuator for bending the partitions of said diaphragm array selectively, wherein said piezoelectric actuator is fixed to and held between one of said upper end wall and said lower end wall of said diaphragm array and a stationary plate for displacement only toward said diaphragm array.

3. An ink jet print head according to claim 2, wherein said diaphragm array is formed of photosensitive glass, said ink channels being formed by a light etching process.

4. An ink jet print head according to claim 2, wherein each of said partitions of said diaphragm has a length larger than a width thereof.

5. An ink jet print head according to claim 2, wherein said piezoelectric actuator is a thin-plate piezoelectric device, wherein the actuator has cutout portions over each of the channels to define individual piezoelectric elements over each of the respective partitions, the elements each having a diaphragm array side facing the diaphragm array, and a stationary plate side facing the stationary plate, the actuator further including individual electrodes formed on the diaphragm-array side of each of said individual piezoelectric elements, and a common electrode formed on the stationary-plate side of said individual piezoelectric elements.

6. An ink jet print head according to claim 2, wherein said piezoelectric actuator has two layers opposite in polarization to each other, said piezoelectric actuator having cutout portions over each of the ink channels to define individual piezoelectric elements over the respective partitions, the elements each having a diaphragm array side facing the diaphragm array, and a stationary plate side facing the stationary plate, the actuator further including individual electrodes formed on the diaphragm-array side of each of said individual piezoelectric elements, and a common electrode formed on the stationary plate side of said individual piezoelectric elements.

7. An ink jet print head according to claim 2, wherein said piezoelectric actuator is disposed outwardly of each of said upper end wall and said lower end wall of said diaphragm array for bending selected partitions from both the upper end wall and lower end wall.

8. An ink jet print head according to claim 2, wherein said ink channels of said diaphragm array are arranged in two rows of individual ink channels, the individual ink channels of each row being displaced at a ½ pitch.

9. An ink jet print head comprising:

(a) a diaphragm array including a group of bending curved partitions, each of said partitions having an upper end and a lower end, the array further including an upper end wall bridging between each said upper end of said partitions, and a lower end wall bridging between each said lower end of said partitions wherein said upper end wall, said lower end wall, and said partitions form ink channels therebetween, said ink channels extending in a first direction and being ordered along a second direction orthogonal to the first direction;

(b) an orifice board fixed to said diaphragm array and facing an end of each of said ink channels, said orifice board having a plurality of ink jet orifices communicating with the respective ink channels;

(c) a back board fixed to another side of said diaphragm array and facing another end of each of said ink channels, said back board having a plurality of ink supply inlets for fluidly communicating with respective ink channels; and (d) a piezoelectric actuator for bending individual partitions of said diaphragm array selectively, wherein said piezoelectric actuator is a thin-plate piezoelectric device formed along said end walls of said diaphragm array, said piezoelectric device having a diaphragm side facing the diaphragm and an open side, wherein on the diaphragm side and on the open side, a common pair of individual electrodes is formed to confront the individual partitions of said diaphragm array, wherein to a desired pair of said electrodes a voltage opposite in polarity to an adjacent pair of electrodes is applied to drive said diaphragm array in a shearing mode.

10. An ink jet printer which comprises an ink jet print head disposed in confronting relation to a recording paper for jetting ink to the paper in a desired dot pattern, an ink source for supplying ink to said ink jet print head, and a scanner movable forwardly and backwardly to scan over the paper, wherein said ink jet print head includes:

(a) a diaphragm array including partitions, each of said partitions having an upper end and a lower end, the array further including an upper end wall bridging between each said upper end of said partitions, and a lower end wall bridging between each said lower end of said partitions, wherein said upper end wall, said lower end wall, and said partitions form into channels therebetween, said ink channels extending in a first direction and being ordered along a second direction orthogonal to the first direction;

(b) an orifice board fixed to one side of said diaphragm array and facing an end of each of said ink channels, said orifice board having a plurality of ink jet orifices for fluidly communicating with respective ink channels;

(c) a back board fixed to another side of said diaphragm array and facing another end of each of said ink channels, said back board having a plurality of ink supply inlets for receiving ink from the ink source; and (d) a piezoelectric actuator for selectively bending individual partitions of said diaphragm array, wherein said piezoelectric actuator is fixed to and held between one of said upper end wall and said lower end wall of said diaphragm array and a stationary plate for displacement only toward said diaphragm array.

11. An ink jet print head comprising:

(a) a piezoelectric diaphragm array formed of a piezoelectric material and including a group of curved partitions, each of said partitions having an upper end wall and a lower end wall, the array further including an upper end wall bridging between each said upper end of said partitions, and a lower end wall bridging between each said lower end of said partitions, wherein said upper end wall, said lower end wall, and said partitions define ink channels therebetween, said ink channels extending in a first direction and being ordered along a second directin orthogonal to the first direction;

(b) an orifice board fixed to one side of said diaphragm array and facing one end of each of said ink channels, said orifice board having a plurality of ink jet orifices for fluidly communicating with the respective ink channels; and (c) a back board fixed to another side of said diaphragm array and facing another end of each of said ink channels, said back board having a plurality of ink supply inlets for fluidly communicating with the respective ink channels.

12. An ink jet print head comprising:

(a) a piezoelectric diaphragm array formed of a piezoelectric material and including a group of curved partitions, each of said partitions having an upper end wall and a lower end wall, the array further including an upper end wall bridging between each said upper end of said partitions, and a lower end wall bridging between each said lower end of said partitions, wherein said upper end wall, said lower end wall, and said partitions define ink channels therebetween said ink channels extending in a first direction and being ordered along a second direction orthogonal to the first direction;

(b) an orifice board fixed to one side of said diaphragm array and facing one end of each of said ink channels, said orifice board having a plurality of ink jet orifices for fluidly communicating with respective ink channels, and (c) a back board fixed to another side of said diaphragm array and facing another end of each of said ink channels, said back board having a plurality of ink supply inlets for fluidly communicating with respective ink channels, wherein the ink channels of said piezoelectric diaphragm array each have a convex side and a concave side and have a common electrode on inner wall surfaces of one of the convex side and the concave side, and individual electrodes on the inner wall surfaces of the other of the convex side and the concave side.

13. An ink jet print head according to claim 11, wherein the ink channels of said piezoelectric diaphragm array have inner walls and have individual electrodes on surfaces of the inner walls.

14. An ink jet printer which comprises an ink jet print head disposed in confronting relation to a recording paper for jetting ink to the paper in a desired dot pattern, an ink source for supplying ink to said ink jet print head, and a scanner movable forwardly and backwardly to scan over the paper, wherein said ink jet print head includes:

(a) a piezoelectric diaphragm array formed of a piezoelectric material and including a group of bendable curved lower end, the array further including an upper end wall bridging between each said upper end of said partitions, and a lower end wall bridging between lower ends of said partitions, wherein said upper end wall, said lower end wall, and said partitions define ink channels therebetween, said ink channels extending in a first direction and being ordered along a second direction orthogonal to the first direction;

(b) an orifice board fixed to one side of said diaphragm array and facing one end of each of said ink channels, said orifice board having a plurality of ink jet orifices communicating with respective ink channels; and (c) a back board fixed to another side of said diaphragm array and facing another end of each of said ink channels, said back board having a plurality of ink supply inlets for fluidly communicating with respective ink channels.

15. An ink jet print head according to claim 10, wherein said piezoelectric actuator is a thin-plate piezoelectric device, wherein the actuator has cutout portions over each of the channels to define individual piezoelectric elements over each of the respective partitions, the elements each having a diaphragm array side facing the diaphragm array, and a stationary plate side facing the stationary plate, the actuator further including individual electrodes formed on the diaphragm-array side of each of said individual piezoelectric elements, and a common electrode formed on the stationary-plate side of said individual piezoelectric elements.

16. An ink jet print head according to claim 10, wherein said piezoelectric actuator has two layers opposite in polarization to each other, said piezoelectric actuator having cutout portions over each of the ink channels to define individual piezoelectric elements over the respective partitions, the elements each having a diaphragm array side facing the diaphragm array, and a stationary plate side facing the stationary plate, the actuator further including individual electrodes formed on the diaphragm-array side of each of said individual piezoelectric elements, and a common electrode formed on the stationary plate side of said individual piezoelectric elements.

17. An ink jet print head according to claim 10, wherein said ink channels of said diaphragm array are arranged in two rows of individual ink channels, the individual ink channels of each row being displaced at a ½ pitch.

18. An ink jet print head comprising:

a diaphragm array having a number of spaced elongated ink channels arranged in an array along a first axis and defining a group of bendable partitions therebetween, each of the ink channels having an ink inlet and an ink outlet, the ink channels having elongated side walls substantially transverse to the first axis; and a piezoelectric actuator abutting the diaphragm array for selectively applying a force to the partitions in a direction perpendicular to the first axis so that the partitions selectively bend in a direction substantially along the first axis.

19. The print head of claim 18 wherein the elongated ink channels are curved along the elongated side walls.

20. The print head of claim 18 wherein the elongated ink channels have straight portions and an angled portion intermediate the straight portions.

21. The print head of claim 18 wherein the piezoelectric actuator includes a plate which is parallel to the first axis, the plate having adjacent portions which are selectively actuable in a second direction substantially transverse to the first axis, wherein one portion moves in the second direction relative to an adjacent portion.

22. The print head of claim 18, further including a stationary plate, wherein the piezoelectric actuator is intermediate the diaphragm array and the stationary plate so that the actuator is displaceable only in the direction of the diaphragm array.

23. An ink jet print head comprising:

a piezoelectric diaphragm array formed of a piezoelectric material and including a plurality of spaced elongated ink channels arranged along a first axis and having elongated side walls which are generally transverse to the first axis, the ink channels defining a number of partitions therebetween, wherein the elongated ink channels are generally V-shaped:

an orifice board adjacent one side of the diaphragm array having a plurality of ink jet orifices communicating with the ink channels: and a back board positioned adjacent another side of the diaphragm array and having a plurality ink supply inlets for supplying ink to the ink channels.

24. An ink jet print head comprising:

a piezoelectric diaphragm array formed of a piezoelectric material and including a plurality of spaced elongated ink channels arranged along a first axis and having elongated side walls which are generally transverse to the first axis, the ink channels defining a number of partitions therebetween, wherein the ink channels are curved along the elongated side walls so that the partitions having a convex side and a concave side in a non-actuated position;

an orifice board adjacent one side of the diaphragm array having a plurality of ink jet orifices communicating with the ink channels; and a back board positioned adjacent another side of the diaphragm array having a plurality ink supply inlets for supplying ink to the ink channels.

25. The print head of claim 24 wherein the concave side of each partition is connected to a common electrode, and the convex side of each partition is connected to a corresponding individual electrode.

26. The print head of claim 24 wherein an electrode is provided on a side wall of each ink channel, wherein a force is provided in a direction of the first axis to a selected ink channel by providing an electrical signal to an electrode in the selected ink channel, and a different electrical signal to an electrode in an ink channel adjacent the selected ink channel.

27. The ink jet print head of claim 24, wherein each elongated ink channel has elongated side walls, a top wall, and a bottom wall, wherein an electrode is provided on an elongated side wall and on at least one of the top wall and the bottom wall of each channel.

* * * * *